US005915417A

United States Patent [19]

Diaz et al.

[11] Patent Number: 5,915,417

[45] Date of Patent: Jun. 29, 1999

[54] AUTOMATIC FLUID FLOW CONTROL APPARATUS

[75] Inventors: Alexander R. Diaz, Greer, S.C.; Ronald L. Roush, Colorado Springs, Colo.

[73] Assignee: T&S Brass and Bronze Works, Inc., Travelers Rest, S.C.

[21] Appl. No.: 08/929,998

[22] Filed: Sep. 15, 1997

[51] Int. Cl.[6] ..... F16K 31/02

[52] U.S. Cl. ..... 137/624.11; 251/129.04; 4/623

[58] Field of Search ..... 251/129.04; 4/623, 4/304, DIG. 3; 137/624.11

[56] References Cited

U.S. PATENT DOCUMENTS

| | | | |
|---|---|---|---|
| 4,309,781 | 1/1982 | Lissau . | |
| 4,682,628 | 7/1987 | Hill . | |
| 4,735,357 | 4/1988 | Gregory et al. . | |
| 4,921,211 | 5/1990 | Novak et al. . | |
| 4,941,219 | 7/1990 | Van Marcke . | |
| 4,972,070 | 11/1990 | Laverty, Jr. . | |
| 5,033,508 | 7/1991 | Laverty, Jr. . | |
| 5,133,095 | 7/1992 | Shiba et al. . | |
| 5,217,035 | 6/1993 | Van Marcke | 4/623 X |
| 5,482,250 | 1/1996 | Kodaira . | |
| 5,566,702 | 10/1996 | Philipp . | |
| 5,570,869 | 11/1996 | Diaz et al. . | |
| 5,651,384 | 7/1997 | Rudrich | 251/129.04 |
| 5,694,653 | 12/1997 | Harald . | |
| 5,743,511 | 4/1998 | Eichholz et al. | 251/129.04 X |

FOREIGN PATENT DOCUMENTS 9400645 1/1994 WIPO .

OTHER PUBLICATIONS

AquaStat, Philipp Research & Development Labs, Inc., Lutz, Florida, "Introducing a Revolutionary New Way to Automatically Turn Faucets On and Off . . . ".

Illinois Master Plumber, Industry News, "Chicago Faucets Launches Eagle Eye Electronic Faucets," Mar. 1994, p. 47.

Coyne & Delany, Co., Charlottesville, Virginia, Brochure regarding The Delany Sensor–Faucets (from Mar. 7, 1997 meeting of ASPE).

Intersan, Brochure, pp. 1–5, regarding The Intersan Electronically Controlled Passive Detection System (at least as early as Jun. 14, 1993).

Sensors, Nov. 1996, "The Charge Transfer Sensor", pp. 36–42.

QProx brochure (1996).

The Chicago Faucet Co., DePlaines, Illinois, Brochure regarding Eagle Eye Electronic Faucet.

*Primary Examiner*—Kevin Lee
*Attorney, Agent, or Firm*—Dority & Manning, P.A.

[57] ABSTRACT

A water faucet assembly includes a faucet operatively connected to a water source, an energy storage element, and a valve in operative communication with the faucet and the water source to selectively permit water flow from the water source to the faucet. A light detector mechanism is configured to detect ambient light. A control mechanism is powered by the energy storage element and is in operative communication with the light detector mechanism and the valve. The control mechanism is configured to activate the valve to permit water flow from the water source to the faucet responsively to the level of ambient light detected by the light detector mechanism.

32 Claims, 23 Drawing Sheets

| FIG. 3A | FIG. 3B |
|---|---|
| | FIG. 3C |

FIG. 5
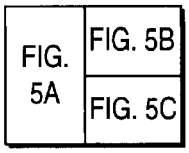
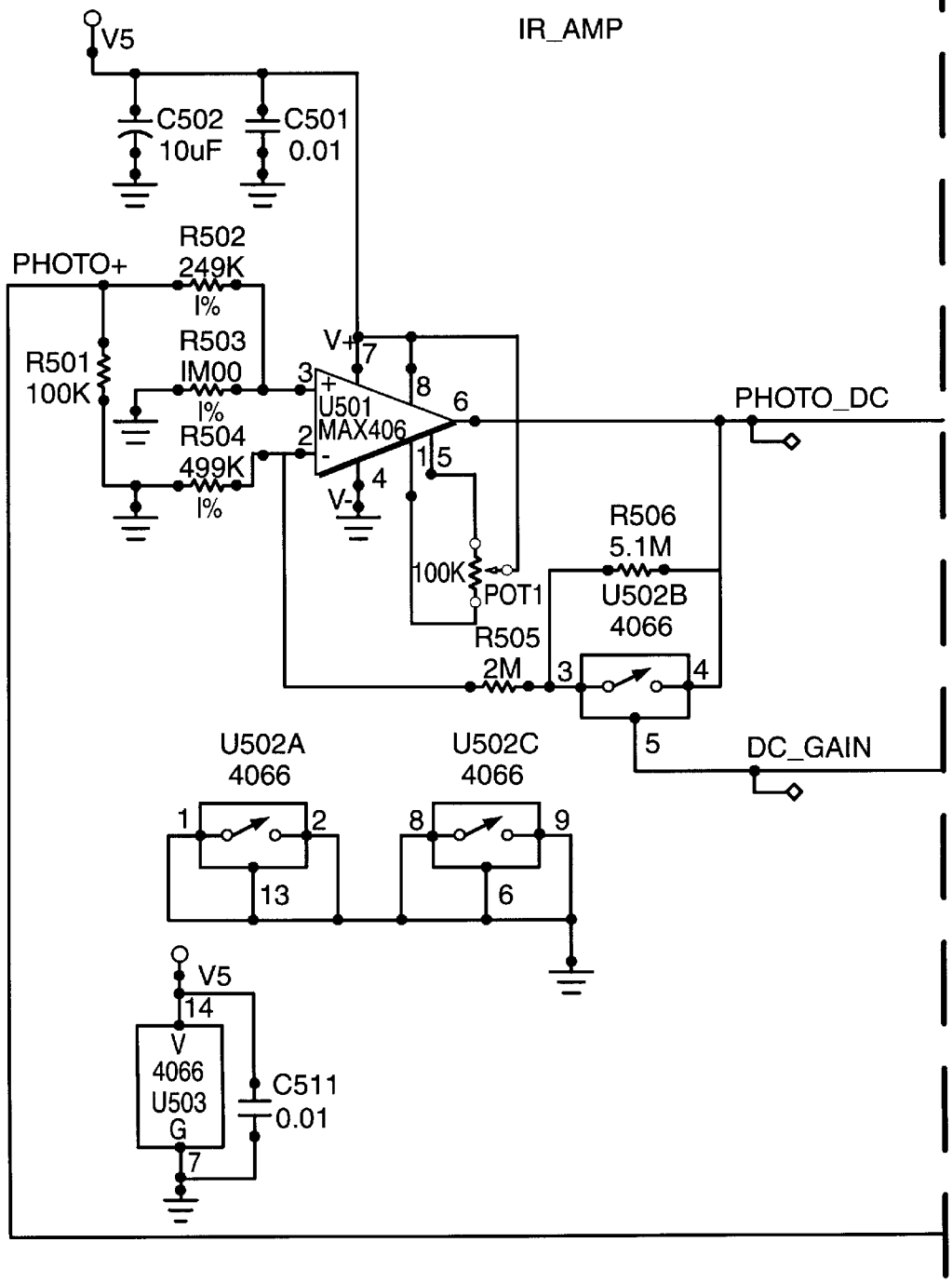
FIG. 5A

AUTOMATIC FLUID FLOW CONTROL APPARATUS

BACKGROUND OF THE INVENTION

The present invention relates to fluid flow control devices. Automatic fluid control devices are presently in common use, particularly in association with water faucets in sinks or toilets. More specifically, it is known in the art to utilize motion detectors and object detectors, such as infrared, electrostatic, temperature or radar sensors, to detect the presence of an object within a detection area necessitating the activation of a water flow device. Certain systems operate responsively to temperature-sensing devices, which activate the water valve based on temperature changes indicating the presence of the user proximate the sensor. In other systems, the valve activates responsively to infrared reflections indicating a user's presence.

Automatic faucets require a power source, for example to operate the components which detect the presence of a user and to open and close a valve to start or stop water flow. When such devices draw power from dedicated power sources, for example AC electric power lines found in commercial and residential buildings, power consumption is a relatively minor concern. However, it is often desirable to employ an energy storage element, for example one or more batteries, instead of relying on dedicated line power.

Unfortunately, energy storage elements have a finite operative life. To extend this life, and thereby reduce maintenance expense and inconvenience, some prior systems employ custom-made batteries, for example constructed from lithium. Although custom batteries may have a greater operative life than conventional batteries available to the public, they are, typically, expensive and constructed from hazardous materials requiring special disposal procedures.

In one known device, the control system deactivates when not in use, thereby preserving battery power. The system operates by sensing changes in an electrostatic field, which is monitored even when the system is in its deactivated state. Thus, the control system may be activated upon an appropriate disturbance in the electrostatic field to determine whether the valve should be activated. Unfortunately, the effectiveness of the electrostatic field may be reduced in certain circumstances where metal is present proximate the device.

SUMMARY OF THE INVENTION

The present invention recognizes and addresses the foregoing disadvantages, and others, of prior art construction and methods.

Accordingly, it is an object of the present invention to provide an improved water faucet assembly which is powered by an energy storage element.

More particularly, it is an object of the present invention to provide such an assembly which enhances the operative life of the energy storage element.

It is a still further object of the present invention to provide such an assembly which operates in an active and an inactive state and which exits the inactive state to the active state based on the detection of ambient light.

It is also the object of the present invention to provide a water faucet assembly which activates a valve to permit water flow from a water source to a faucet upon detection of a user within an area proximate the faucet before the user reaches the faucet.

Some of these objects are achieved by a water faucet assembly comprising a faucet operatively connected to a water source, an energy storage element, and a valve in operative communication with the faucet and the water source to selectively permit water flow from the water source to the faucet. The assembly also includes a light detector mechanism configured to detect ambient light and a control mechanism powered by the energy storage element and in operative communication with the light detector mechanism and the valve. The control mechanism is configured to activate the valve to permit water flow from the water source to the faucet responsively to the level of ambient light detected by the light detector mechanism.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which:

FIGS. 5, 5A, 5B and 5C are partial electrical diagrams of an embodiment of the present invention;

FIGS. 6, 6A, and 6B are partial electrical diagrams of an embodiment of the present invention;

FIGS. 8, 8A and 8B are partial electrical diagrams of an embodiment of the present invention;

Figure 1:
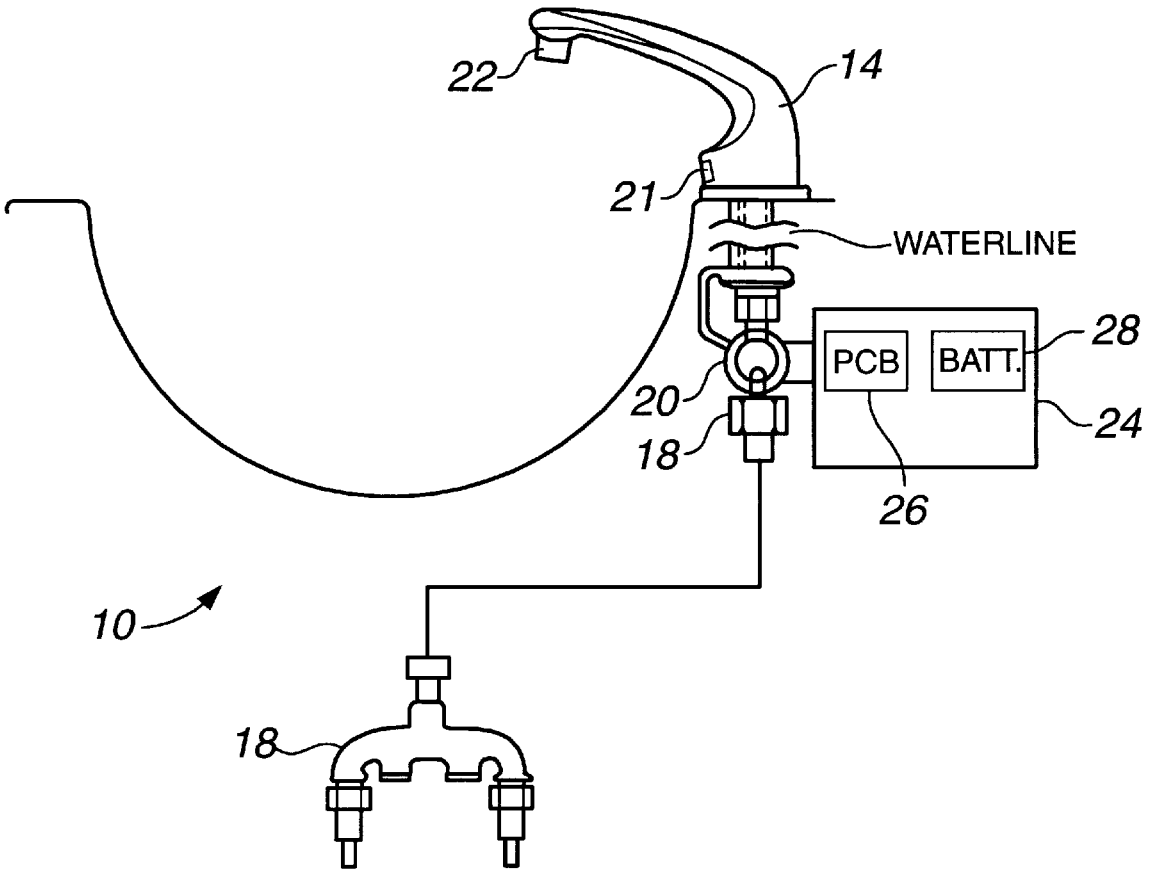
FIG. 1 is a schematic illustration of an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment.

The present invention is concerned with a fluid flow control apparatus for utilization with a fluid flow system. Accordingly, FIG. 1 depicts a water faucet and sink assembly, indicated generally at 10, including an infrared signal source and receiver 12 housed within the base of a faucet 14. The infrared signal source is isolated from the infrared receiver by an opaque mounting and aiming block (not shown). Both are housed behind a protection lens. Construction and operation of an AC-powered faucet control system is disclosed in U.S. Pat. No. 5,570,869, the disclosure of which is fully incorporated by reference herein.

A water flow system is comprised of a water source 16, water filter 18, water solenoid valve 20 and spout 22. A control box 24 houses printed circuit board 26 which communicates with infrared sensor and emitter 12 to send and receive infrared signals and with solenoid 20 to open and close the solenoid as described below. Batteries 28 supply all power to the system, including printed circuit board 26. Preferably, housing 24 is a waterproof casing, and printed circuit board 26 is sealed to prevent moisture contamination.

Figure 2:
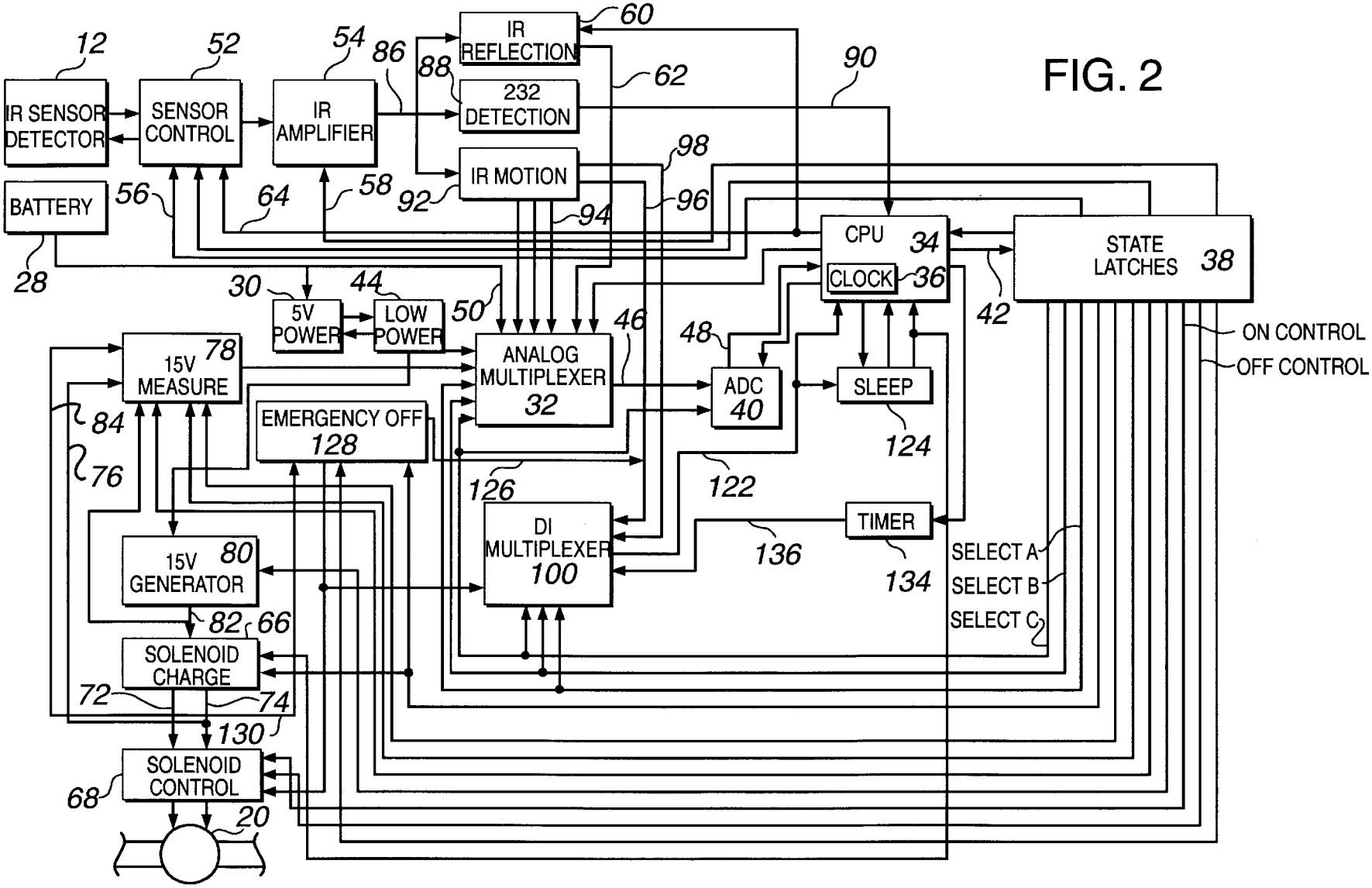
FIG. 2 is a partial block diagram illustration of an embodiment of the present invention.

One preferred realization of the fluid flow control apparatus is depicted in FIG. 2. A sensor circuit includes sensor 12. A control mechanism includes a signal acquisition circuit, a processor circuit and a valve control circuit. The signal acquisition circuit includes a sensor control 52, infrared amplifier 54, infrared reflection circuit 60, detection circuit 88 and infrared motion circuit 92. The processor circuit includes CPU 34, state latches 38, sleep circuit 124, timer 134, multiplexers 32 and 100, converter 40, power source 30, low power circuit 44 and fifteen volt measurement circuit 78. The valve control circuit includes solenoid control 68, solenoid charge circuit 66, fifteen volt generator 80 and emergency off circuit 128. It should be understood, however, that the schematic illustration of FIG. 2, and the circuit diagrams of FIGS. 6–15, are presented as a means of explanation and example only, not as a means of limitation. For example, any suitable circuitry should be understood to be within the scope of the present invention.

All of the functional blocks illustrated in FIG. 2 are located on printed circuit board 26 (FIG. 1) except for infrared emitter and sensor 12, solenoid 20 and batteries 28. Batteries 28 provide power to all the components on board 26, delivering three volts to a five volt power source 30 to provide the five volt signals required by various components on the board. As described below, batteries 28 are also connected to an analog multiplexer 32 so that battery level may be monitored. For purposes of clarity, however, all but one of the connections from the five volt power source 30 to the circuit board components are omitted.

A CPU 34 executes a program to control the circuitry of the printed circuit board. Upon power up, all inputs and outputs to the CPU are pulled low to allow a clock 36 to operate properly. The program loaded in the CPU then defines the appropriate CPU inputs and outputs and checks a calibration voltage to assure that state latches 38, analog multiplexer 32 and analog-to-digital converter 40 are operating properly. In general, CPU 34 controls circuit board components through state latches 38 through a control line 42, which may include several separate control lines, by causing one or more of the output lines from state latches 38 to go high or low as needed. Thus, to check the calibration voltage, CPU 34 outputs an appropriate signal over state latches output lines SELECT A, SELECT B and SELECT C instructing analog multiplexer 32 to pass the calibration voltage, which is provided to multiplexer 32 from Low Power circuit 44, to converter 40 over line 46 and on to CPU 34 over line 48. The CPU then instructs the multiplexer to pass the battery voltage, which is preferably at least 1.5 times the calibration voltage, from line 50 to the CPU through converter 40. The program also checks the output of multiplexer 32 and converter 40 when a ground is input to the multiplexer. Ideally, the converter 40 output should be zero. Thus, the amount by which the converter 40 output exceeds zero is an offset that is applied to subsequent signals received from the converter.

The CPU program then measures ambient light detected by sensor 12. Sensor 12 is a predominantly infrared sensor. It will, however, detect a certain range of visible light within the visible red range. Sensor 12 functions both as an ambient light detector and a receiver of returned infrared pulses. Responsively to detected light, sensor 12 outputs a signal to Sensor Control 52, which amplifies and passes the signal to amplifier 54. The gains of Sensor Control 52 and amplifier 54 are set over lines 56 and 58, respectively, by CPU 34. The CPU sets each gain to a "high" or "low" level. Since the output signal from sensor 12 passes through both Sensor Control 52 and amplifier 54, and since each may be set to one of two gain levels, the system may amplify the sensor 12 output to any of four gain levels. To initially test ambient light, CPU 34 sets both gain levels low.

Infrared Reflection Circuit 60 filters fluctuations, for example the 120 hertz fluctuation typically caused by electric lights, from the ambient light signal output from amplifier 54. CPU 34 reads the now-smoothed ambient light signal over lines 62, 46 and 48 through multiplexer 32 and converter 40. CPU 34 reads the ambient light in this manner for each of three gain settings: low, medium and high. At the low gain level, the CPU sets both lines 56 and 58 low. At medium gain, one of the lines is high and the other low, and at high gain both are high. Thus, at the end of the test, CPU 34 has measured three samples of the ambient light corresponding to three separate gain settings of Sensor Control 52 and amplifier 54. The CPU makes only three ambient light measurements because, in this embodiment, only three of the four possible amplifying conditions are utilized. The middle gain may be set by bringing either line 56 or line 58 high, since the respective gain levels of Sensor Control 52 and amplifier 54 are the same. It should be understood, however, that the system could be constructed to utilize four, or any number, of gain levels.

The ambient light signal output from amplifier 54 should be within a range useful to the system. For example, because system components respond to signals within the range of zero volts to five volts, input signals greater than five volts are seen as, or "clipped" at, five volts. Since ambient signals are used as a background values for comparison to other signals, they should be sufficiently below five volts to provide a range for the other signals. For example, if a user's hand reflects an infrared signal to sensor 12 which raises the output from amplifier 54 by approximately three volts, the ambient light signal within the system should be less than two volts. Otherwise, the returned signal caused by the input of the hand into the sink will be clipped, and information will be lost. On the other hand, the ambient light signal must be set high enough to permit the system to detect a user's approach to the sink, since this typically reduces the ambient light received by the sensor. Furthermore, the ambient light should be relatively close to the calibration voltage discussed above to maximize confidence in the ambient signal.

Accordingly, the CPU cycles through the three ambient light signal readings until finding one within a range of approximately three-eighths to one and one-half times the calibration voltage. The greater range above the calibration voltage is due to the non-linearity of the voltage measurement procedure. Upon finding a signal falling within this range, the CPU leaves Sensor Control 52 and amplifier 54 at the gain settings which produce the acceptable ambient light signals.

If the ambient light signals for all three gain settings are below the above-described acceptable range, the CPU program determines that the system may not be in a functional environment or that the sensor 12 may be disconnected. The CPU continues, however, to test ambient light in an attempt to achieve an acceptable level.

If an acceptable ambient light signal is detected, an infrared signal is emitted from sensor 12. CPU 34 activates Sensor Control 52 over line 64 to generate the signal from sensor 12. Line 64 is also directed to IR Reflection circuit 60. The pulse on this line temporarily closes a switch in IR Reflection circuit 60 so that the return infrared signal amplified by Sensor Control 52 and amplifier 54 and directed to IR Reflection circuit 60 is directed to a capacitor which is quickly charged by the incoming signal. The end of the pulse on line 64 releases the switch so that the capacitor holds the received infrared signal for measurement. That is, IR Reflection circuit 60 acts as a sample and hold circuit. CPU 34 then measures the returned infrared signal stored on the capacitor through multiplexer 32 and converter 40 from line 62. If this signal is greater than a predetermined amount above the ambient signal, the infrared emitter is determined to be operating properly. In one embodiment, this predetermined amount is two "counts" by which signals are measured by the circuitry, as described in more detail below.

CPU 34 next tests Solenoid Charge circuit 66, which powers a Solenoid Control circuit 68 through a pair of capacitors. Through state latches 38 and the OFF CONTROL line, CPU 34 issues an "off" command to Solenoid Control 68 to close solenoid 20. This should cause the capacitor pair in Solenoid Charge circuit 66 to drain through Capacitor Off line 72. Capacitor On line 74 should track the Capacitor Off line. Through the SELECT lines from state latches 38, CPU 34 reads the Capacitor Off line 72 through line 76, Fifteen Volt Measurement circuit 78 and converter 40. This signal should be low. CPU 34 then activates Fifteen Volt generator 80, without activating Solenoid Charge circuit 66, and measures the output of line 82 through Fifteen Volt Measurement circuit 78. With Fifteen Volt Generator 80 activated, CPU 34 activates Solenoid Charge circuit 66 so that the generator 80 charges both capacitors. CPU 34 then measures the state of Capacitor On line 74. If this value is relatively high, it is determined that the solenoid system is functioning properly.

Once the testing is complete, CPU 34 calibrates various system parameters. As described above, the system operates in three gain modes, which are described herein as low, medium and high. For each gain mode, the system calibrates a "background" value, a "ping" value and a "ripple" value. The background value is a measure of the ambient light signal. The ping value is a measure of the increase above the background value caused by a returned infrared signal. The ripple is a measure of ambient light variation, typically caused by light fluctuations from light bulbs. The background value and the ping value vary by the ripple amount. At start up, the background value is the ambient light signal value found during the testing stage. The ping and ripple values are each at a suitable default value, for example zero.

Whether an ambient light signal or a reflected infrared signal, the signal passed through Sensor Control 52 and amplifier 54 to output line 86 includes the 120 hertz ripple. Infrared Reflection circuit 60 averages the signal from line 86 using a resistor and capacitor combination, and the output of Infrared Reflection circuit 60 on line 62 is the average, or smoothed, signal. To calibrate the background value, CPU 34 takes four measurements of the smoothed signal from line 62, summing the measurements and remembering the minimum and maximum values. If the difference between the minimum and the maximum is less than a predetermined amount, for example ten percent of the average, the light is stable, and the average of the four measurements is stored as the background value. If the difference between the maximum and minimum values is greater than the predetermined amount, the ambient light is changing to a degree that may require the faucet to activate, and CPU 34 returns to a searching state to determine whether the faucet should be activated.

The values of the measurements discussed herein are referred to as "voltage" measurements. However, it should be understood that voltage values in the circuitry illustrated in the figures are measured using a ramp circuit. Specifically, a voltage to be measured, or test voltage, is applied to one input of a comparator, the other input of which is the output of a ramp circuit which ramps at a known rate. The value of the test voltage is determined by counting the number of program loops required before the ramp voltage exceeds the test voltage, causing the comparator to change state. Thus, a test voltage is measured as a number of program "counts". As should be understood in this art, such counts are made at machine speed.

To calibrate the ping value, CPU 34 outputs an infrared signal from sensor 12 in RS 232 format. That is, the infrared signal is comprised of a series of pulses in a predetermined code. For example, the code may be for the letter "A". The signal corresponding to the infrared echo received by sensor 12 is output from amplifier 54 to Infrared Reflection circuit 60 and Detection circuit 88. As described above, the pulses in the returned infrared signal are captured by the sample and hold circuit of IR Reflection circuit 60, repeatedly driving circuit 60 so that the maximum pulse value may be measured from line 62. The detection circuit detects the rising and falling edges of the pulses within the returning infrared signal and outputs this information as digital data to CPU 34 over line 90 for comparison with the sent infrared signal. If the returned signal matches the sent signal, the strength of the infrared signal is measured from line 62. The difference between this signal and the background signal is the ping value. A total of four ping measurements are made and averaged for the calibrated ping value.

To determine the ripple value, CPU 34 measures the varying infrared return signal from line 86 through Infrared Motion circuit 92 and line 94. Eight such measurements are taken, recording the minimum and maximum values. The difference between the minimum and maximum values is the ripple. It should be understood, however, that line 86 may be passed directly to multiplexer 32. Additionally, the ripple may be estimated by recording the difference between the minimum and maximum signal values measured while calibrating the background value.

The system calibrates the background, ping and ripple values at each of the three gain settings as described above. If a calibration is unsuccessful, the system repeats the process up to five times to attempt to achieve an adequate calibration.

Once the calibrations are completed, the system enters its normal mode of operation. In general, the system attempts to operate effectively while minimizing battery usage. Thus, under certain conditions, the system enters a "sleep" mode, as is discussed in more detail below. Motion Detection circuit 92 provides information to determine whether the system should enter or exit a sleep mode. Motion Detection circuit 92 detects motion by monitoring ambient light, reducing the need for power-depleting infrared signal emission. Thus, the system is at least partially passive. It is able to make decisions based on reception of ambient light conditions rather than emission and reception of its own signals.

Motion Detection circuit 92 directs the ambient light signal from line 86 through two capacitors, one being much larger than the other. The larger capacitor charges and discharges more slowly than the smaller capacitor. Since it reacts more slowly to ambient light changes, the larger capacitor acts as a memory device. Thus, the voltage across the large capacitor is an indication of the ambient light at a time prior to the present reading indicated by the voltage across the small capacitor.

Each of the two capacitor outputs is applied to two comparators. Each comparator compares the output of the small capacitor to the output of the large capacitor, but in different orientations, so that the comparators form a window comparator structure. The output 96 of the high comparator goes high when the "present" ambient light is higher than the "memory" ambient light, and the output 98 of the low comparator goes high when the present ambient light goes below the memory ambient light. Thus, line 96 is high when the ambient light is increasing, and line 98 is high when the ambient light is decreasing, with respect to a stored prior ambient light level. There is a small range below the trigger level of each comparator creating a small "window" in which the present ambient light can change from the memory ambient light while maintaining the comparators' outputs low. In this case, the present ambient light is approximately equal to the memory ambient light. In one preferred embodiment, the present ambient light value may be within approximately 0.5% of the memory value without triggering the comparators.

CPU 34 monitors the output of motion detector 92 by selecting inputs 96 and 98 to digital multiplexer 100. As with analog multiplexer 32, CPU 34 selects an input to digital multiplexer 100 by appropriate signals on the SELECT lines from state latches 38.

Referring now to FIGS. 2, 3A, 3B and 3C, once calibration is complete, CPU 34 enters an idle/sleep routine 142. If batteries 28 are low at 102, the faucet turns off at 104. If the battery level is acceptable, CPU 34 monitors the ambient light signal from line 86 at 106 to assure that it is a relatively constant value or that it is changing unidirectionally. If not, sleep mode is inappropriate, and the system exits the idle/sleep routine at 108. If the ambient signal is smooth at 106, but is not within the predetermined operational range discussed above, the gain of Sensor Control 52 and/or amplifier 54 is adjusted at 110 to bring the ambient signal within this acceptable range. As discussed above, there are three gain levels used in the illustrated embodiment. If two gain adjustments are required, the second is performed at 111.

Following the gain adjust, the CPU waits for the ambient signal to smooth at 112. The CPU then checks the "on" capacitor in Solenoid Charge circuit 66 at 114 to assure that it is sufficiently charged. The capacitor should be charged when the system goes to sleep so that the faucet may be immediately activated when the system wakes up. If the capacitor is not sufficiently charged, it is recharged at 116. If it is sufficiently charged, the CPU waits for the ambient signals from Motion Detection circuit 92 to stabilize at 118. That is, the CPU waits for both outputs 96 and 98 of Motion Detection circuit 92 to go low. If this fails to happen, conditions are unacceptable for sleep mode, and the routine is exited at 108.

If lines 96 and 98 go low to allow sleep, CPU 34 enables the appropriate settings through state latches 38 at 120 to wake the circuit up under the proper conditions. Specifically, the CPU enables Motion Detection circuit outputs 96 and 98 to the multiplexer 100. The multiplexer includes an OR circuit receiving the motion detector outputs so that a signal is output over line 122 to Sleep circuit 124 should either of lines 96 and 98 change state, indicating a change in the ambient light level that indicates a motion condition. Thus, once the system goes to sleep, it is waked up should the passive Motion Detection circuit 92 recognize a change in the ambient light level. The degree of change required to wake the system up is determined by the comparator window discussed above with respect to Motion Detection Circuit 92. In a preferred embodiment, the system wakes up should the present ambient light change from the memory ambient light by or more than approximately 0.5 percent. It should be understood, however, that any suitable level may be used, for example approximately zero.

An output line 126 from Emergency Off circuit 128 is tied to output line 96 from Motion Detection circuit 92. The valve 20 is operated through a passive energy storage element, in this case a pair of capacitors in Solenoid Charge circuit 66. Output line 126 goes high when the signal from line 130 indicates that the off capacitor in circuit 66 has discharged. This causes the OR signal in multiplexer 100 to change state, waking the circuit up. Thus, even if no motion is detected, the system wakes up when the solenoid capacitors discharge below a predetermined value, thereby allowing the system to recharge the capacitors at 116. This step may be omitted, however, where the capacitors are likely to have enough time, following a long sleep period but before the faucet is required to activate, to recharge.

Once the appropriate inputs to multiplexer 100 are set at 120, the system goes to sleep at 132. The system may enter different sleep modes depending on system conditions such as the gain level and the ambient light level. For example, if the gain is either low or middle, the ambient light is high enough to enter "ambient" sleep mode, where the system is shut down as described below and where a wake-up occurs if line 96 or line 98 goes high. Where the high gain is used, however, the ambient light is lower than when the system uses the low and middle gains. If the ambient light is too low, hardware configurations within the Motion Detection circuit 92 cause the OR signal from multiplexer 100 to maintain a high value, which would immediately wake up the system should it go to sleep. Specifically, the low bit 98 would remain high. Thus, although it should be understood that various other suitable circuit configurations could be used, the system hardware determines a "dark limit". Accordingly, if the system is to enter sleep mode when the Sensor Control and amplifier are set to the high gain, the CPU checks the ambient signal on line 86 to determine whether it is below this predetermined "dark" limit. Although dependent on system hardware, in one embodiment the dark limit is approximately 0.2 volts.

Where the ambient light is below the dark limit, there may be so little light that the faucet is not usable. That is, there may be so little light, for example less than one foot-candle, that the average user could not see and is unlikely to use the faucet. Therefore, any ambient light change which would require faucet activation will most likely be an increase. Thus, if the ambient light signal 86 is below this "inactive" ambient light level, which is a further distinction below the dark limit, the system goes into "dark" sleep, in which the CPU selects only the high input 96 as the active input to multiplexer 100 from Motion Detection circuit 92. Thus, only a high signal on line 96, indicating that light has increased, awakens the circuit.

If the ambient light is above the inactive level but below the dark limit, the ambient light level is too low for Motion Detection circuit 92 to adequately notify the CPU of light decreases but too high for the system to rely solely on light increases to wake up. Accordingly, the system uses infrared signals to determine whether a possible faucet-activating condition exists. CPU 34 initiates an infrared RS 232 signal, or ping, once per second, going to sleep between the pings.

Figures 3, 3A:
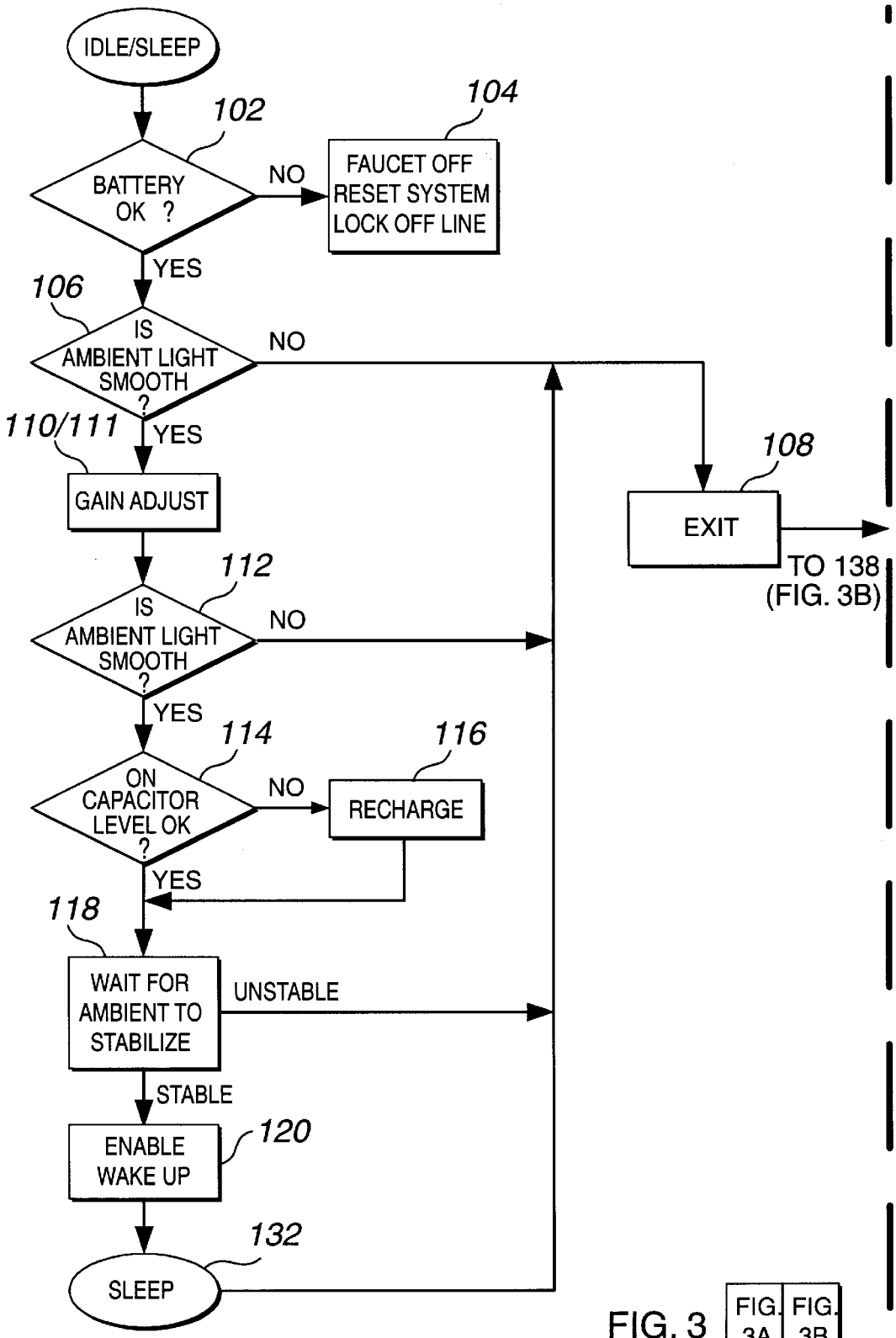
FIGS. 3, 3A, 3B and 3C are partial flow charts illustrating exemplary operation of the present invention.
Figure 3B:
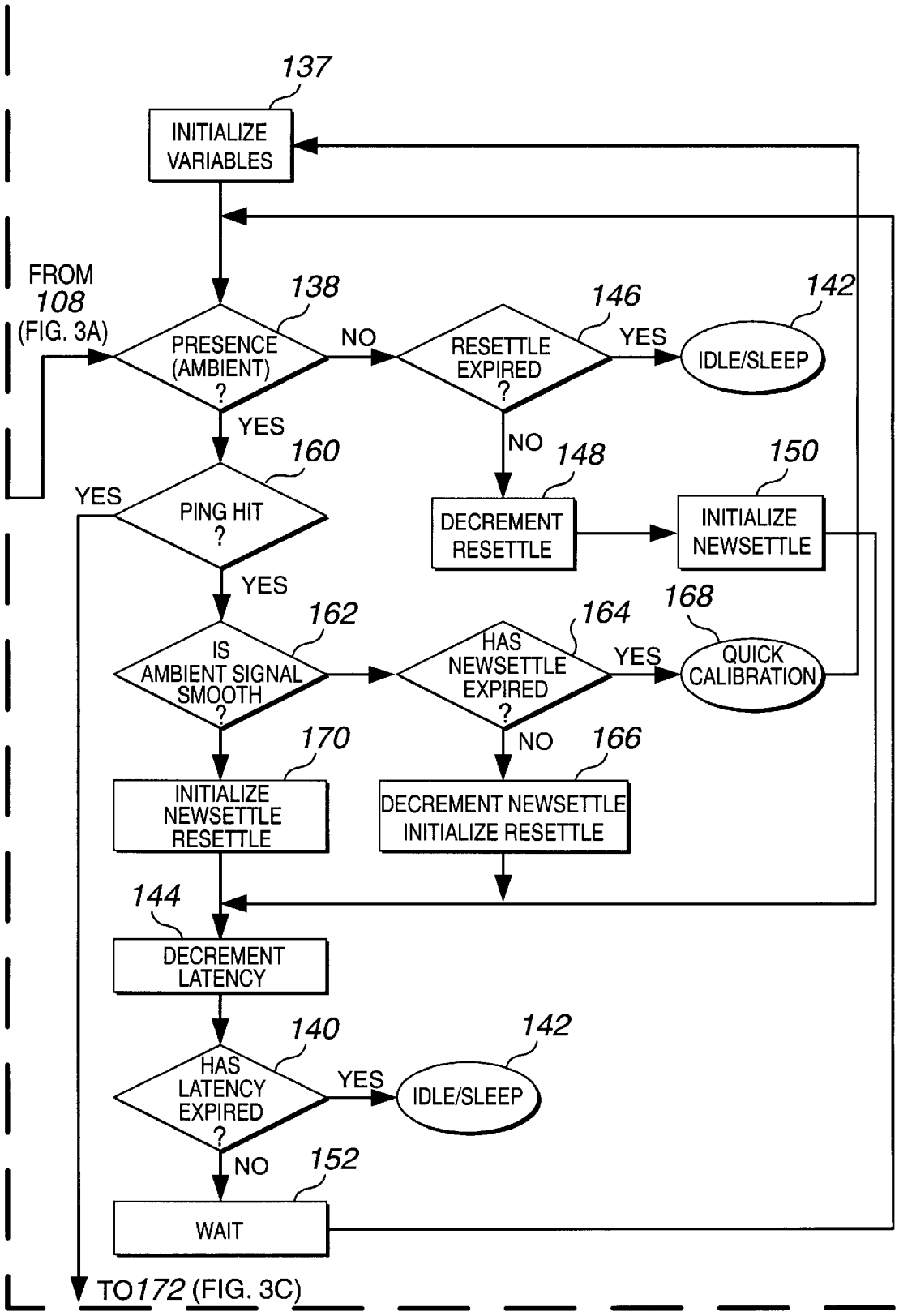
Figure 3C:
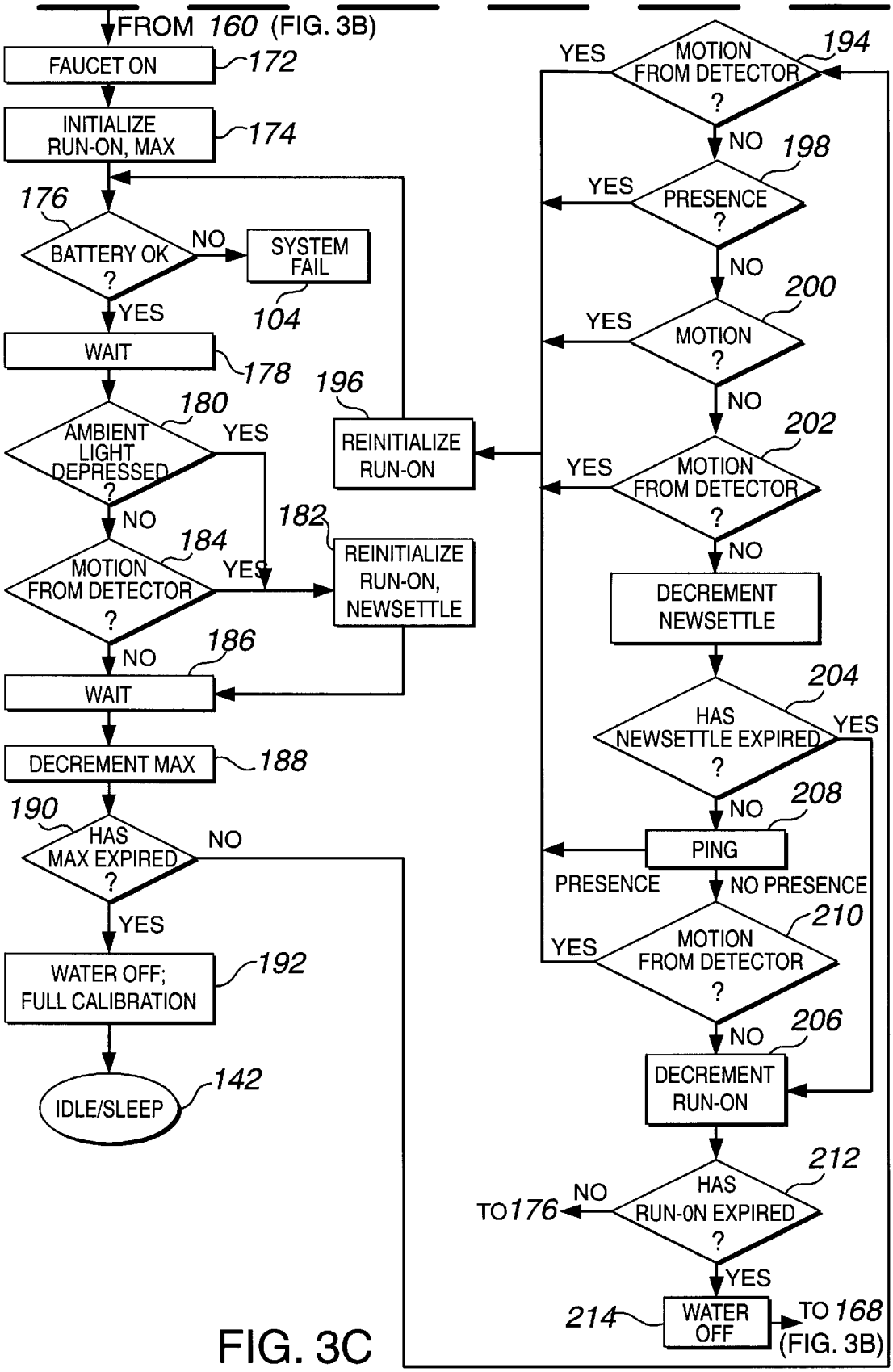

After initiating a ping, CPU 34 activates Sleep circuit 124, to put the system to sleep, and activates Timer circuit 134, to awaken the system in one second. At the end of one second, Timer circuit 134 issues a signal to multiplexer 100 over line 136 to cause Sleep circuit 124 to awaken CPU 34 to issue another ping. A ping takes approximately 15 ms, after which the system returns to sleep. The ping value was calibrated as described above for the particular gain setting, in this case the highest gain setting. If CPU 34 detects a slight predetermined variation, for example plus or minus approximately ten percent, from the calibrated ping response, it exits the sleep mode at 108 (FIGS. 3A–3C).

In sleep mode, the CPU performs a shut down of its internal components and any appropriate external components, such as the IR LED system. Thus, for example, no infrared signals are issued during sleep mode, and therefore the infrared signal source may be considered disabled. To further save energy, clock 36 is also shut down. CPU 34 remains asleep until reactivated by an interrupt signal from Sleep circuit 124.

When Sleep circuit 124 receives an appropriate signal from multiplexer 100, it wakes up CPU 34. CPU 34 then powers up the LED circuit and disables the output of line 126 from Emergency Off circuit 128. Batteries 28 are also checked at this time.

Following wake up, CPU 34 checks the ambient signal on line 86 to make sure that the signal is smooth. If so, the CPU waits for 200 ms and checks the ambient signal again. If the signal is smooth and within the acceptable operating range as described above, the system is ready to operate. If the ambient light has changed so that the ambient light signal on 86 is no longer in the appropriate operating range, CPU 34 adjusts the gains of Sensor Control 52 and the amplifier 54 so that an ambient light signal on line 86 within the operating range is achieved.

Since the background level is unlikely to be equal to the background level calibrated during the original calibration routine for this particular gain level, the system performs a "quick" calibration routine. Rather than returning through the original calibration process, CPU 34 issues a single infrared signal from sensor 12 and measures the reflected signal. It then replaces the originally calibrated ping value with the average of the originally calibrated ping value and the newly detected ping value. It also measures the ambient light level, replacing the originally calibrated background level with the average of the original and the newly detected values.

Since a condition has occurred to cause the system to wake up, a search mode is entered to determine whether a condition exists to activate the faucet. Referring to FIG. 3B, the CPU initializes variables at 137 and checks the possibility of a user's presence proximate the sink at 138. This is a check of the ambient light level 86. Since a user typically reduces the amount of light received by sensor 12, a user's approach to the sink typically reduces the ambient light level monitored by the system. However, there are conditions in which light will be increased, for example where a light colored object is brought toward or into a more darkly colored sink. If the ambient light level checked at 138 has not increased or decreased more than a predetermined amount from the value determined at the quick calibration described above, a RESETTLE value is checked at 146. RESETTLE is the number of times in a row that the routine fails to detect the possibility of a user's presence at 138. RESETTLE is initialized at 137 to a value, for example 32, which is less than the value of a second variable, LATENCY, which measures the total number of times the system should check at 138 before going to sleep. LATENCY is also initialized at 137 and may be set, for example, to 64 or 128. The system waits 200 ms at 152 before returning to the check at 138. Thus, if no change is detected at 138, the system returns to sleep after approximately six seconds due to the expiration of RESETTLE.

The predetermined value used to detect the possibility of presence at 138 should create a relatively narrow band about the quick calibration light level. In the embodiment illustrated herein, the voltage measurement scale is nonlinear. Thus, the acceptable band varies depending on voltage level. In the present circuit, however, the threshold band is approximately 12% above and 12% below the quick calibration value. Since the system often operates based upon a quick calibration, the present description assumes the use of the ambient background following a quick calibration as the stored prior ambient light level against which current ambient light is compared. It should be understood, however, that the prior value use at 138 may be the originally calibrated ambient background.

If RESETTLE has not expired at 146, it is decremented at 148, the variable NEWSETTLE is initialized at 150, and LATENCY is decremented at 144. NEWSETTLE is used to determine when another quick calibration should be performed. As described below, NEWSETTLE is decremented when the ambient light level remains steady at a level different than the ambient light level background at the previous quick calibration. If LATENCY has expired at 140, the system enters the idle/sleep routine at 142.

If the possibility of presence is detected at 138, CPU 34 issues an infrared signal from sensor 12 (FIG. 2) at 160. The system monitors the reflected infrared signal for comparison to the stored ping value that was calibrated at start up for the particular gain level at which the system is operating and that may have been replaced at a prior quick calibration. Typically, there will be a slight difference between these values. If the difference is greater than the ripple value plus a noise factor, for example from 5% to 10% of the ping value, a "hit" is determined at 160, and a condition exists to turn the faucet on. Thus, the "presence" check at 138 is a screen to determine whether a condition exists that might require the faucet's activation. This triggers the issuance of an infrared signal to determine if a user is actually in the detection area.

To determine whether a hit has occurred, the reflected infrared signal value may be adjusted to account for the reduction in ambient light which may be caused by a user's presence. Specifically, a user at a sink may block some of the ambient light otherwise detected by the sensor, and which was likely detected at the prior calibration. Accordingly, for the ping calculation at 160, the difference between the actual ambient light level and the background level is determined and halved. If this value is positive and is greater than the ripple value, it is added to the returned infrared signal value for comparison to the stored ping value as discussed above.

A ping hit occurs when the reflected signal, which may be adjusted as discussed above, differs from the stored ping value by more than a predetermined amount. In one preferred embodiment, for example for use in a sink, the faucet is activated responsively to the magnitude of this difference, regardless of whether the returned signal level is above or below the stored value. This takes advantage of the generally lesser reflectivity of the user's hands compared to the sink edge to allow the faucet to be activated before the user's hands reach the faucet.

Specifically, a calibration ping value is typically determined by an infrared signal reflected from the sink edge opposite the faucet. If a user places his hands in the sink near this edge, the reflected signal value may actually decrease from the calibration value. As the hands approach the sink, however, the returned signal value increases. Because the faucet is activated responsively to either increases or decreases, the faucet may turn on when the user's hands are at the far side of the sink. Since users often put their hands into sinks in front of, rather than directly under, the faucet, this starts water flow before the hands reach the faucet, allowing the user to place his hands into an existing water stream.

If no hit is detected at 160, the system checks to see whether the ambient signal is smooth at 162. This is accomplished by repeatedly measuring the signal from IR Reflection circuit 60 (FIG. 2). If this value is consistently steady, increasing or decreasing, the signal is smooth. A smooth signal indicates that the ambient light is stable and that there is probably no motion proximate the faucet. The ripple value is used to allow for slight variations in the signal.

If the ambient signal is smooth at 162, the ambient light level is at a level significantly different than the ambient light background level determined at the previous quick calibration. This may indicate a need to perform another quick calibration, and the NEWSETTLE value is checked at 164. If NEWSETTLE has not expired at 164, it is decremented, and RESETTLE is initialized, at 166, and presence is checked again at 138. If this continues, and NEWSETTLE expires, a quick calibration is performed at 168. About three seconds are required to cause another quick calibration when no ping hits occur.

If the ambient signal is not smooth at 162, NEWSETTLE and RESETTLE are initialized at 170, and the LATENCY variable is decremented at 144.

Referring again to FIG. 2, if a ping hit is detected at 160 (FIG. 3B), CPU 34 issues an ON command through state latches 38 over the ON CONTROL line to solenoid control 68. This activates the solenoid 20, thereby opening the valve to activate the faucet.

Referring now to FIG. 3C, RUN-ON and MAX are initialized at 174 when the faucet is activated at 172. The battery is checked at 176. If the batteries are low, a system fail condition is entered at 104. If the batteries are sufficiently charged, the system waits for one-half second at 178 and checks the ambient light level from line 86 (FIG. 2) at 180. If the ambient light level is sufficiently lower (for example 12%) than the ambient background level at the last quick calibration, a user is likely in front of the faucet, and a RUN-ON variable is reinitialized at 182. NEWSETTLE is also reinitialized at 182 to a value, for example eight, different from that discussed with respect to FIG. 3B. RUN-ON and NEWSETTLE are also reinitialized at 182 if the ambient light is not depressed at 180, but the output lines 96 and 98 from Motion Detection circuit 92 (FIG. 2) indicate motion at 184. RUN-ON is a variable used to deactivate the faucet. In a preferred embodiment, RUN-ON is set so that if no conditions exist to continue running the faucet, the faucet is turned off in approximately three seconds. If the system detects presence or motion proximate the faucet at 180 or 184, RUN-ON is reinitialized so that the faucet continues to run.

After a half second wait at 186, a MAX variable is decremented at 188. MAX is used to determine the total period the faucet is allowed to run without a calibration. MAX may be set to any desired length, and in a preferred embodiment is set to approximately 30 seconds. If MAX has expired at 190, the solenoid is shut off at 192, and a full calibration is performed as described above with respect to startup.

If MAX has not expired at 190, the output of Motion Detection circuit 92 (FIG. 2) is checked at 194. If motion is detected, RUN-ON is reinitialized at 196, and the loop is continued at 176. If no motion is detected at 194, presence is checked at 198 using the same routine indicated at 138 in FIG. 3B. If presence is detected at 198, RUN-ON is reinitialized at 196.

If no presence is detected at 198, motion is checked at 200 by a software routine executed by CPU 34. CPU 34 samples the ambient light signal from line 86 (FIG. 2) at 50 ms intervals looking for rising and falling changes from one ambient signal to another of more than a predetermined amount. Thus, the CPU makes at least three measurements of the ambient signal, each approximately 50 ms apart. The difference between the ambient light signals required for the system to recognize motion is set by the number of program counts, in this case two counts. As discussed above, program counts correspond to voltage, but since the present measurement is nonlinear, the actual voltage difference will vary depending upon the value of the ambient signal.

If motion is detected at 200, RUN-ON is reinitialized at 196. If no motion is detected at 200, the outputs 96 and 98 of Motion Detection circuit 92 (FIG. 2) are checked at 202 for motion. If motion is detected at 202, RUN-ON is reinitialized at 196. If not, NEWSETTLE is checked at 204, and ambient signal smoothness is checked as at 162 in FIG. 3B. If the ambient signal is smooth and not approximately equal to the ambient background value from the last quick calibration, and if NEWSETTLE has decremented to zero, RUN-ON is decremented at 206. If the ambient signal at 204 is not smooth, or if NEWSETTLE has not decremented to zero, CPU 34 causes sensor 12 (FIGS. 1 and 2) to emit an infrared signal at 208. If presence is detected by the return infrared signal, RUN-ON is reinitialized at 196. If no presence is detected at 208, motion is checked at 210, and RUN-ON is decremented at 206. Although the absolute value of the difference between the returned signal and the stored ping value, as discussed above with respect to 106, may be used at 208, in a preferred embodiment presence is detected at 208 only when the returned signal value is greater than the stored value by a predetermined amount.

As is illustrated, NEWSETTLE is used for a different purpose in FIG. 3C than in FIG. 3B. In FIG. 3B, NEWSETTLE is used to determine when a quick calibration is needed. In FIG. 3C, it is used to reduce the number of pings to extend battery life.

RUN-ON may be set to any appropriate value, for example approximately three seconds as described above. If RUN-ON has expired at 212, water is turned off at 214. If RUN-ON has not expired, the system returns to 176.

After water is shut off at 214, the system executes a slight delay, a quick calibration at 168 (FIG. 3B), and returns to the variable initialization at step 137 of FIG. 3B. After full calibration at 192, the system returns to idle/sleep 142. Rather than proceeding directly to 142, a presence check at 138 may follow the calibration.

Accordingly, the system may enter a sleep mode upon the expiration of one of, or some combination of, RESETTLE, LATENCY and RUN-ON. It may also enter a sleep mode following running of the faucet for a period such as MAX.

As discussed above, several conditions could cause the system to exit from a sleep mode. In response, the system exits sleep mode at 108 (FIGS. 3A–3C) and performs a presence check at 138 (FIG. 3B). This is a check of the ambient light level. Thus, for example, if the turning on or off of a light causes the system to exit a sleep mode, a change in ambient light will be indicated at 138. If there is no object in the detection area, no hit is detected at 160, and the ambient signal should be smooth at 162. Because the light level has changed, the system will cycle through this pattern until NEWSETTLE expires at 164, causing a quick calibration at 168. NEWSETTLE is then initialized at 137. Since the quick calibration replaces the previously calibrated ambient signal with an average value, multiple quick calibrations may be required before no presence is indicated at 138 and the system returns to sleep at 142 following the expiration of RESETTLE.

If the system wakes up due to a change in ambient light caused by a user's approach, presence is detected at 138, and a hit is detected at 160 where the user's hands are placed in the sink. If the user continues to move his hands in the detection area, this will be identified by one of the checks illustrated in FIG. 3C, and the faucet continues to run for approximately 30 seconds. At the expiration of MAX, a full calibration is attempted at 192. If the user continues to move his hands in the detection area, however, the system exits the calibration and reactivates the faucet, for example by reentering the routine at 138 (FIG. 3B). If the user removes his hands before MAX expires, RUN-ON expires after approximately 3 seconds, and the faucet turns off. If an object, such as a towel, is placed in a sink but is not removed, so that the faucet is activated and MAX expires, a full recalibration is performed at 192, thereby permitting subsequent use of the faucet.

Figure 4:
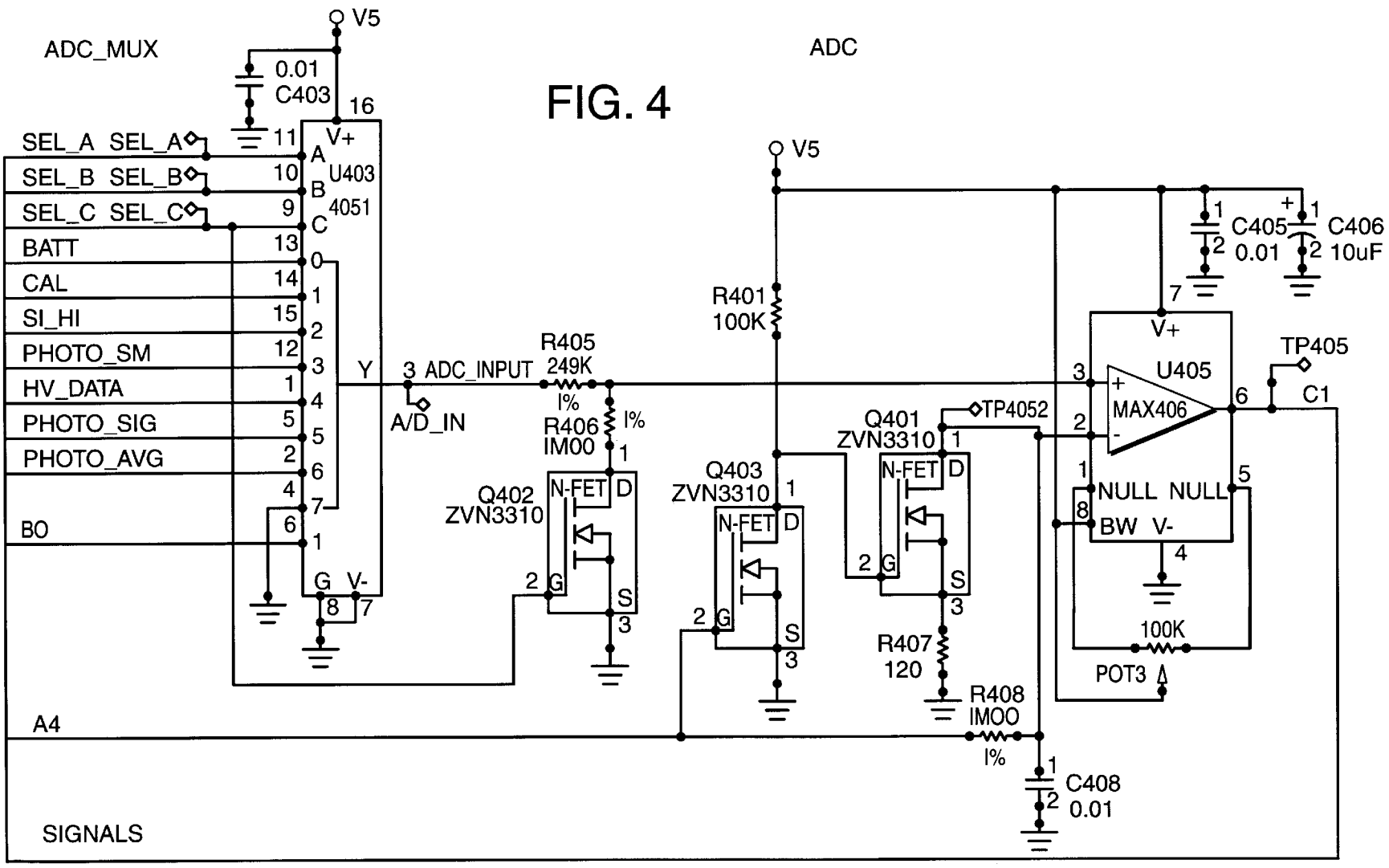
FIG. 4 is a partial electrical diagram of an embodiment of the present invention.
Figure 5B:
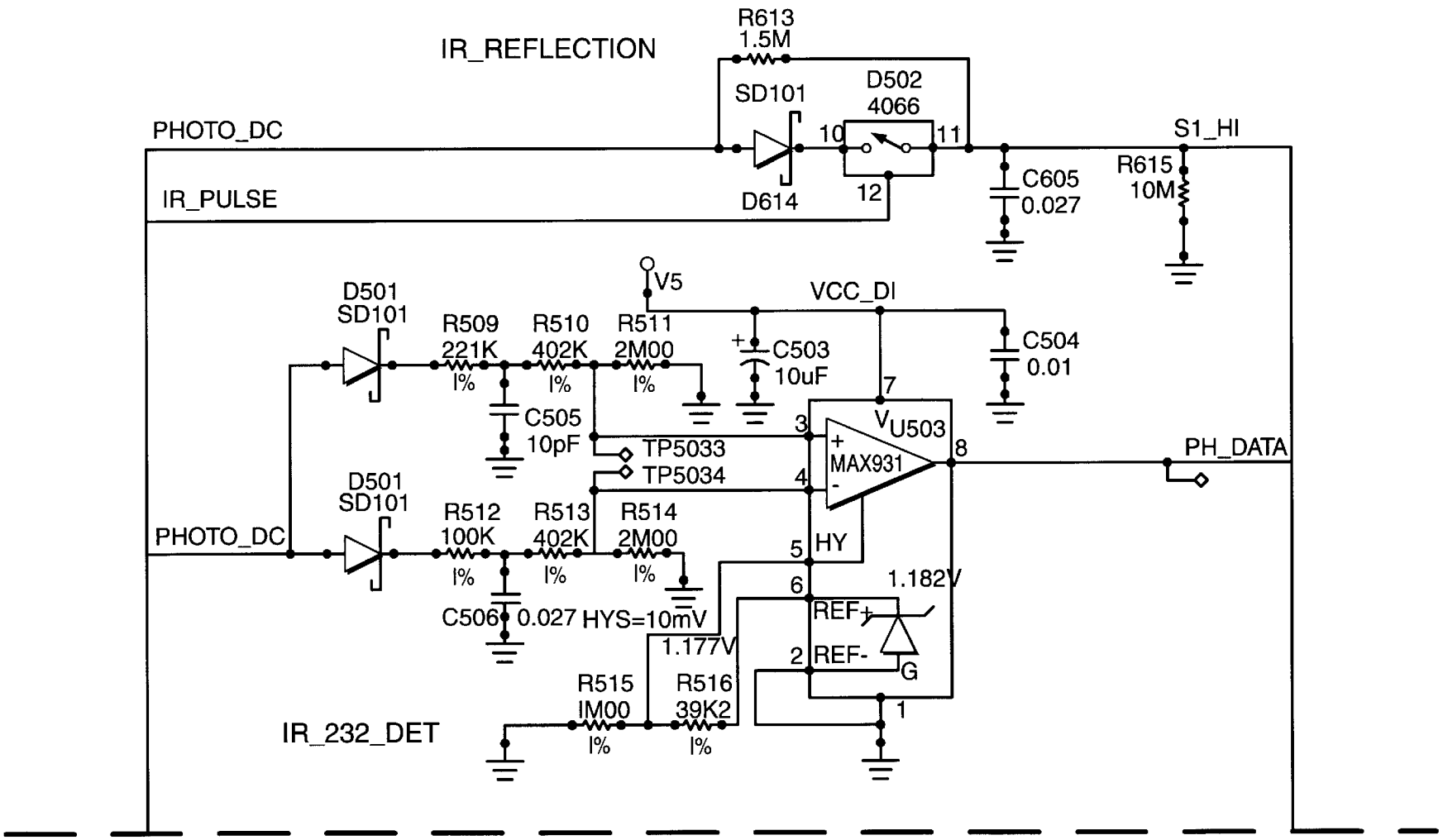
Figure 5C:
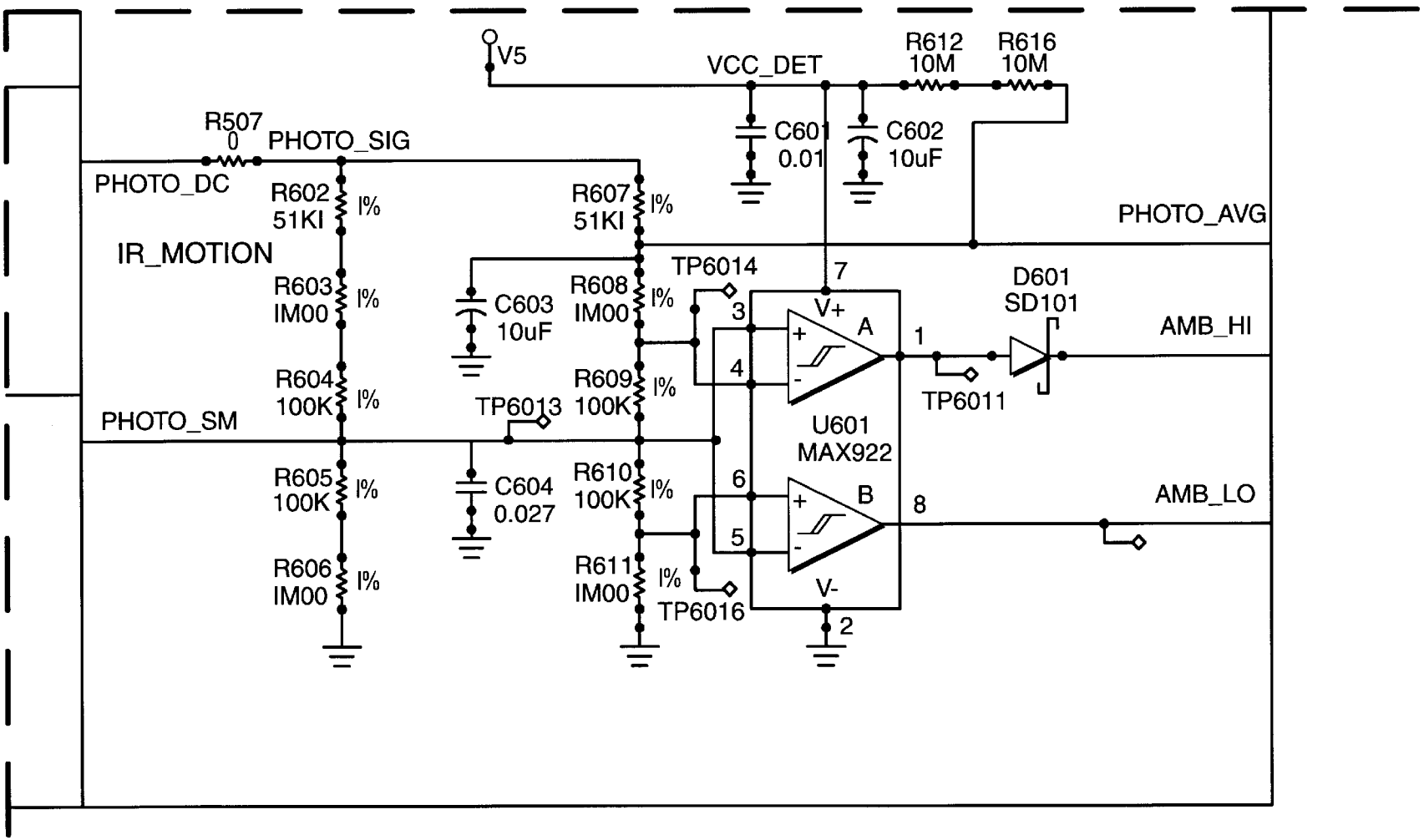
Figure 6A:
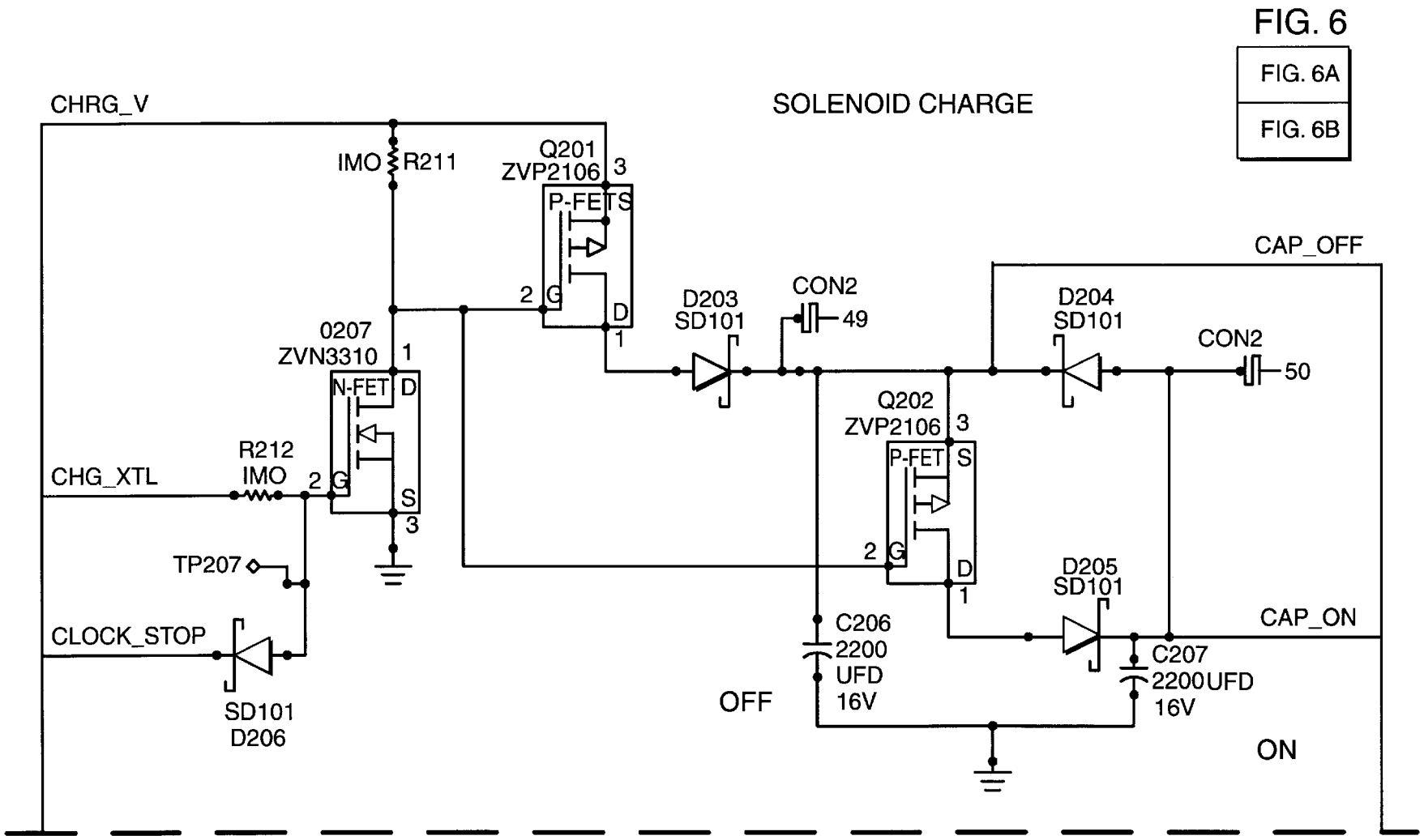
Figure 6B:
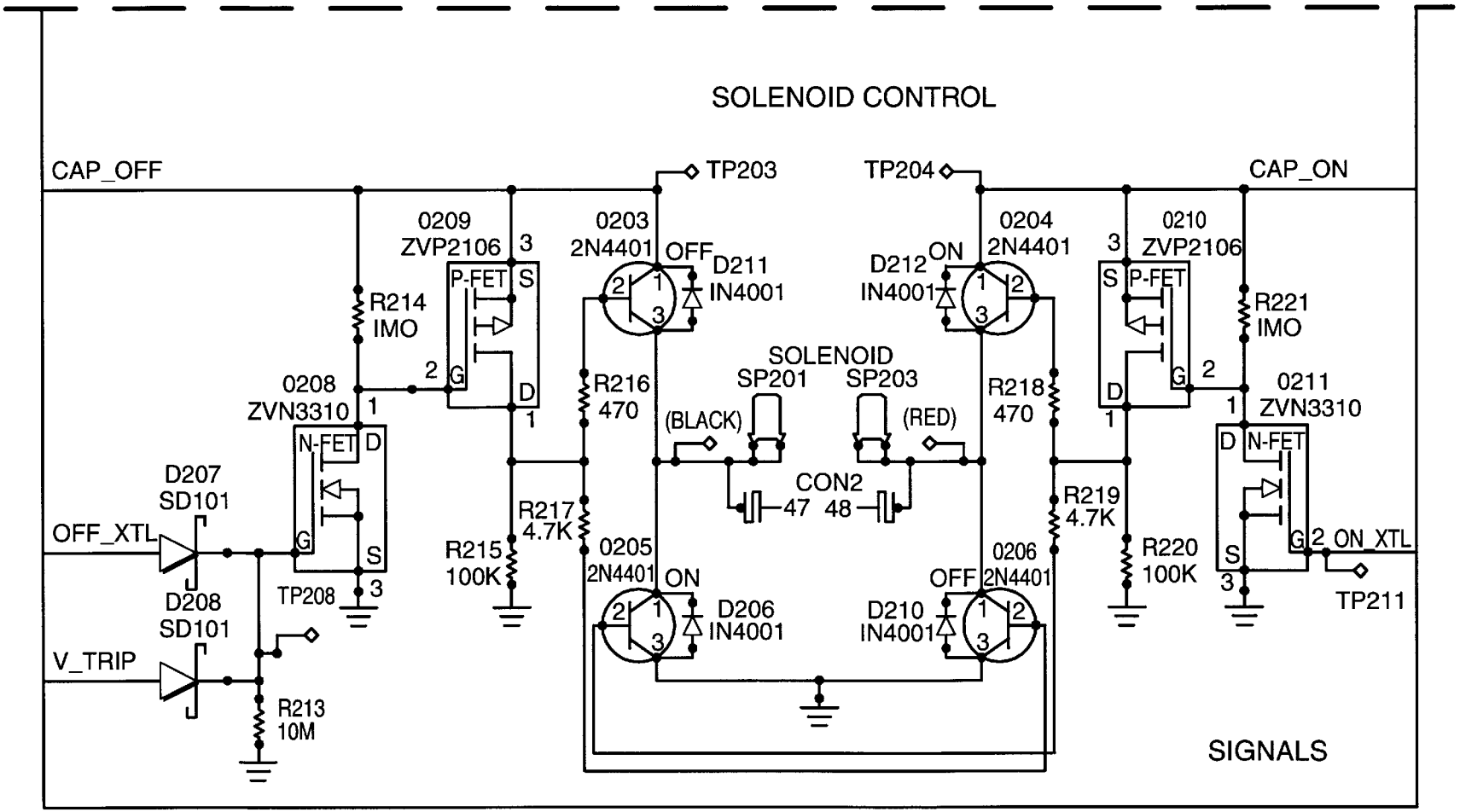
Figure 7:
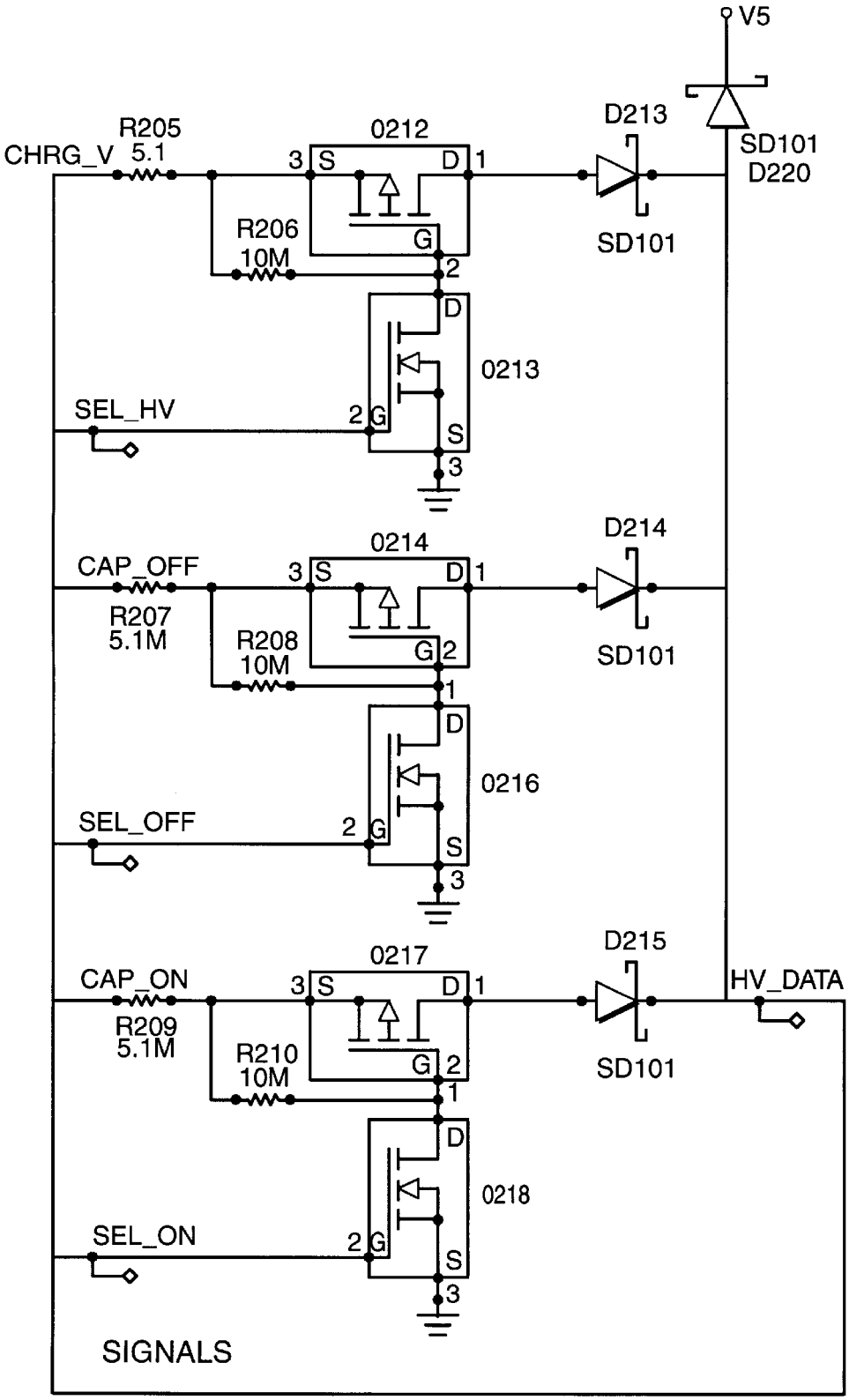
FIG. 7 is a partial electrical diagram of an embodiment of the present invention.
Figure 8A:
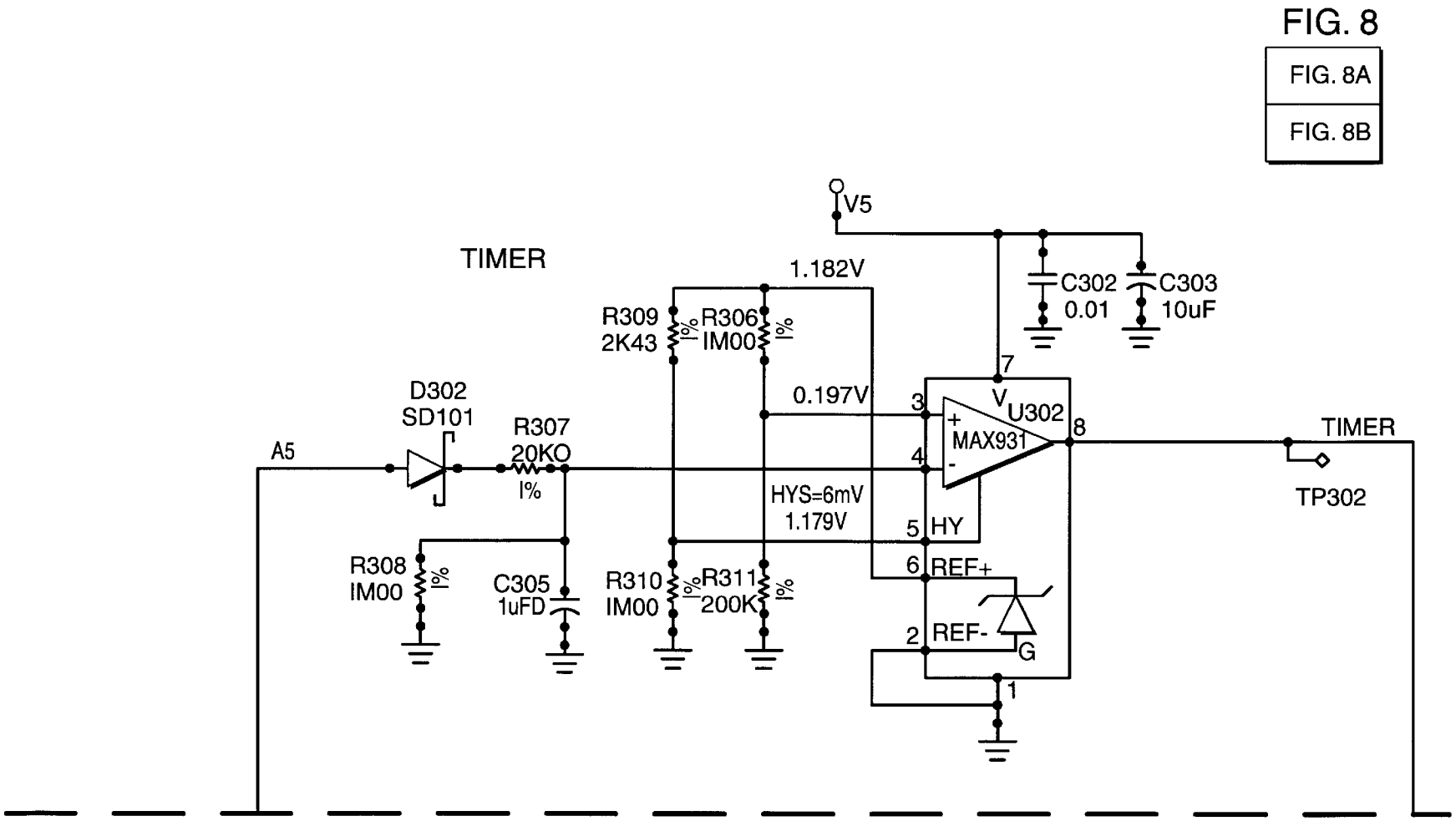
Figure 8B:
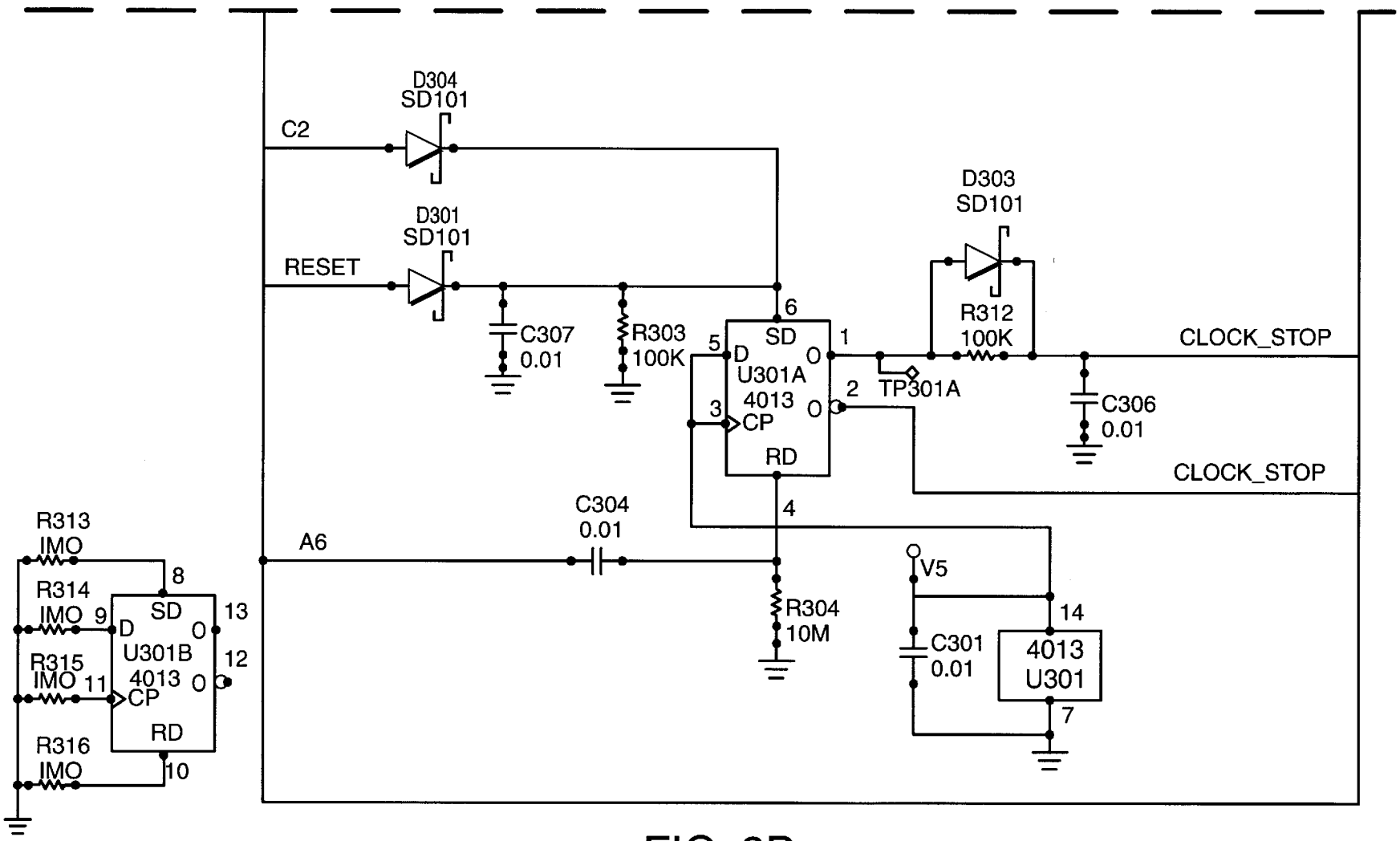
Figure 9:
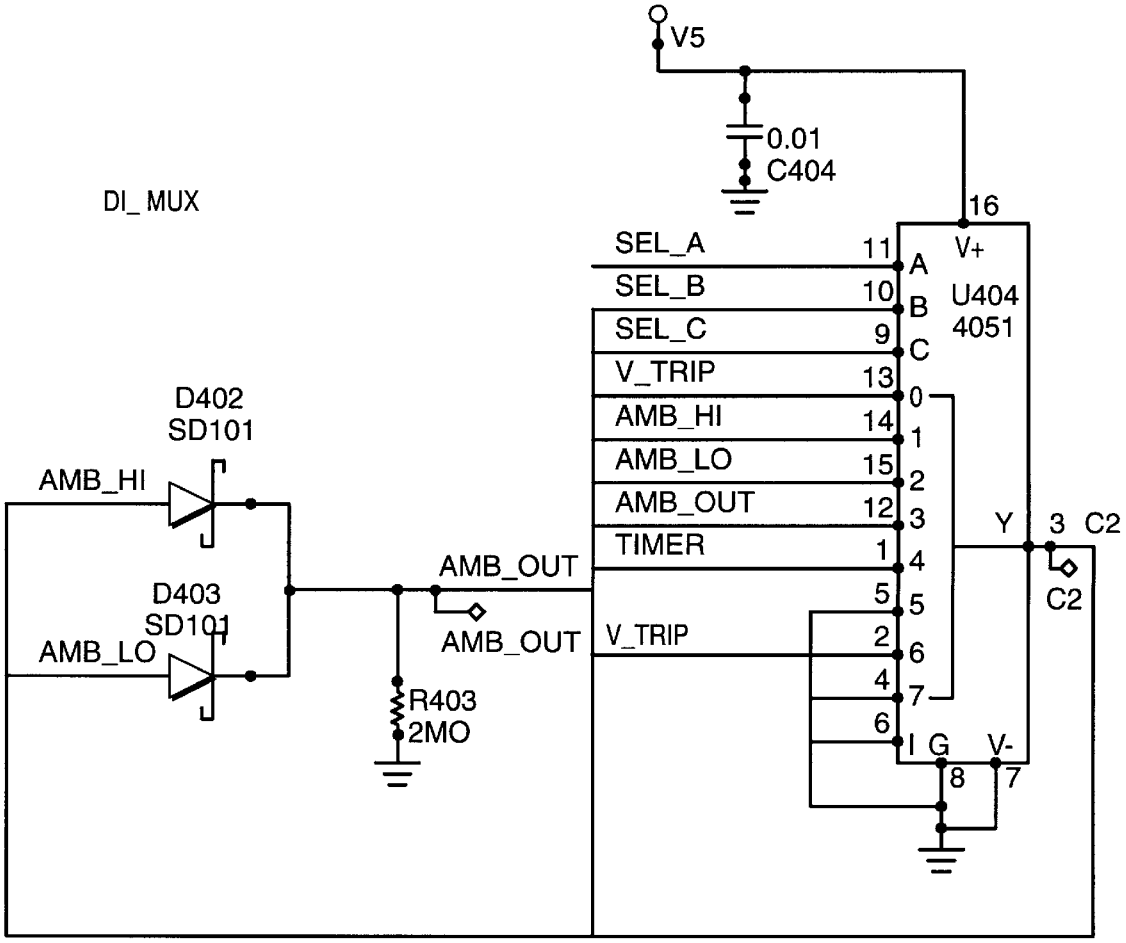
FIG. 9 is a partial electrical diagram of an embodiment of the present invention.
Figures 10, 10A:
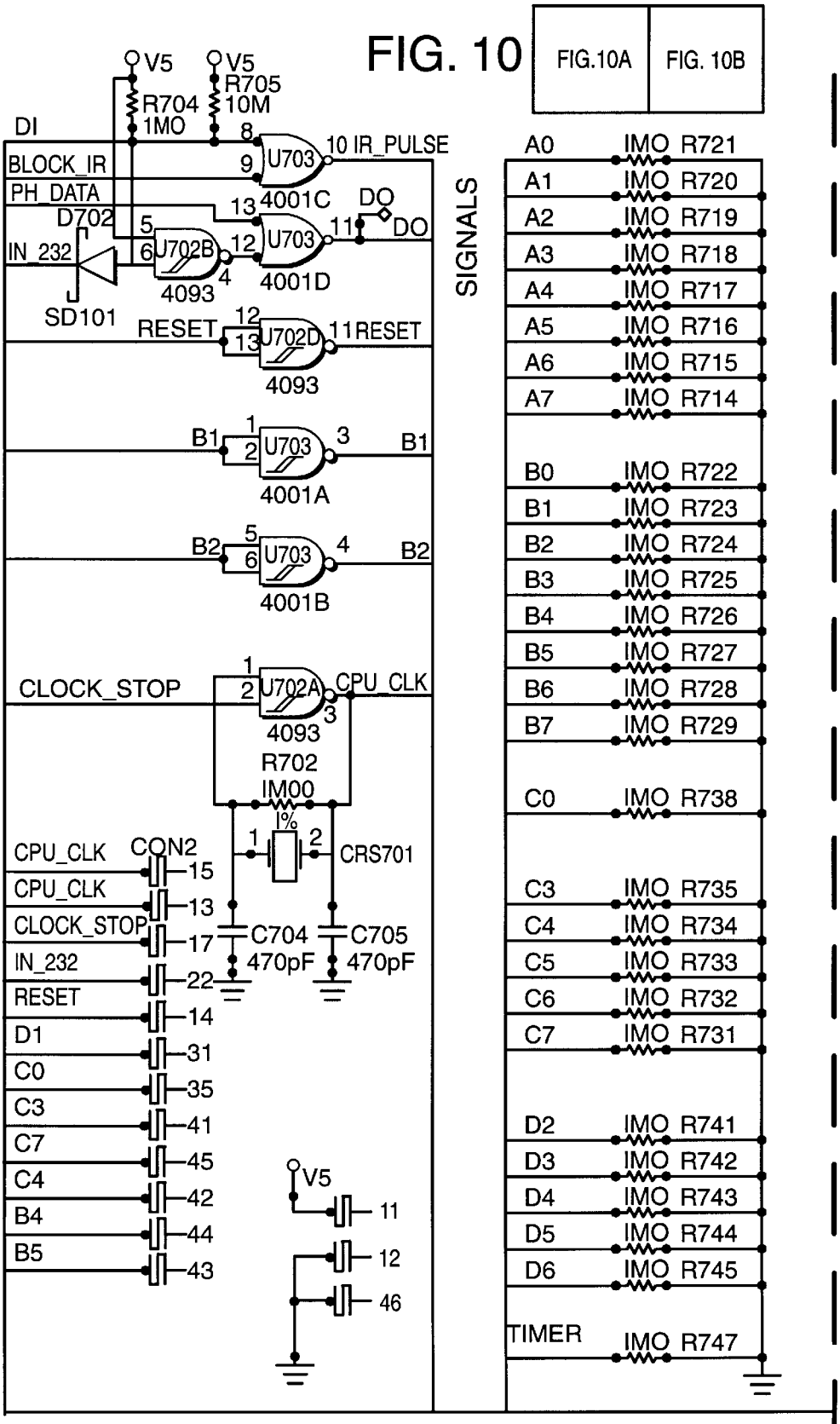
FIG. 10, 10A and 10B are partial electrical diagrams of an embodiment of the present invention.
Figure 10B:
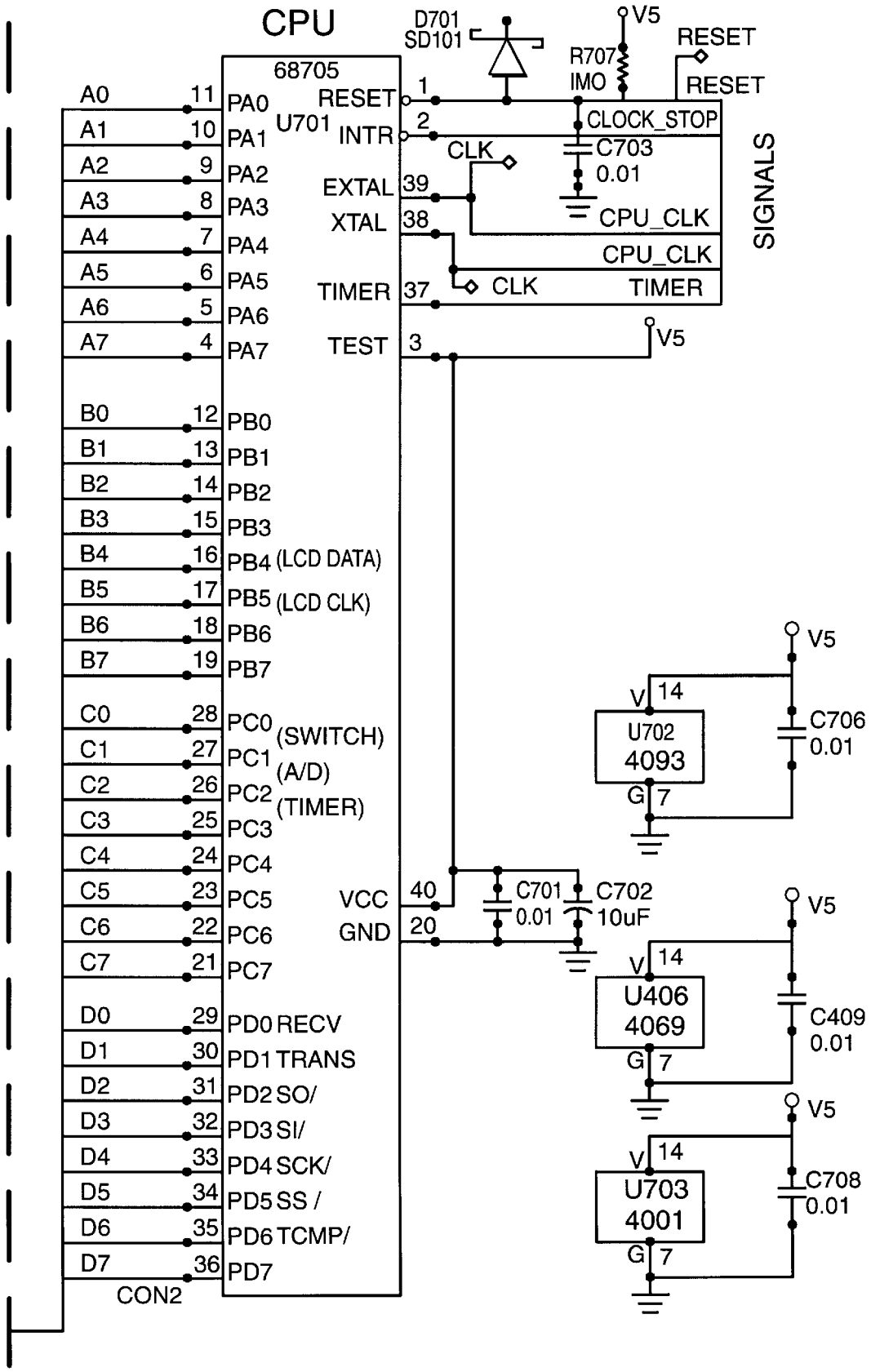
Figure 11:
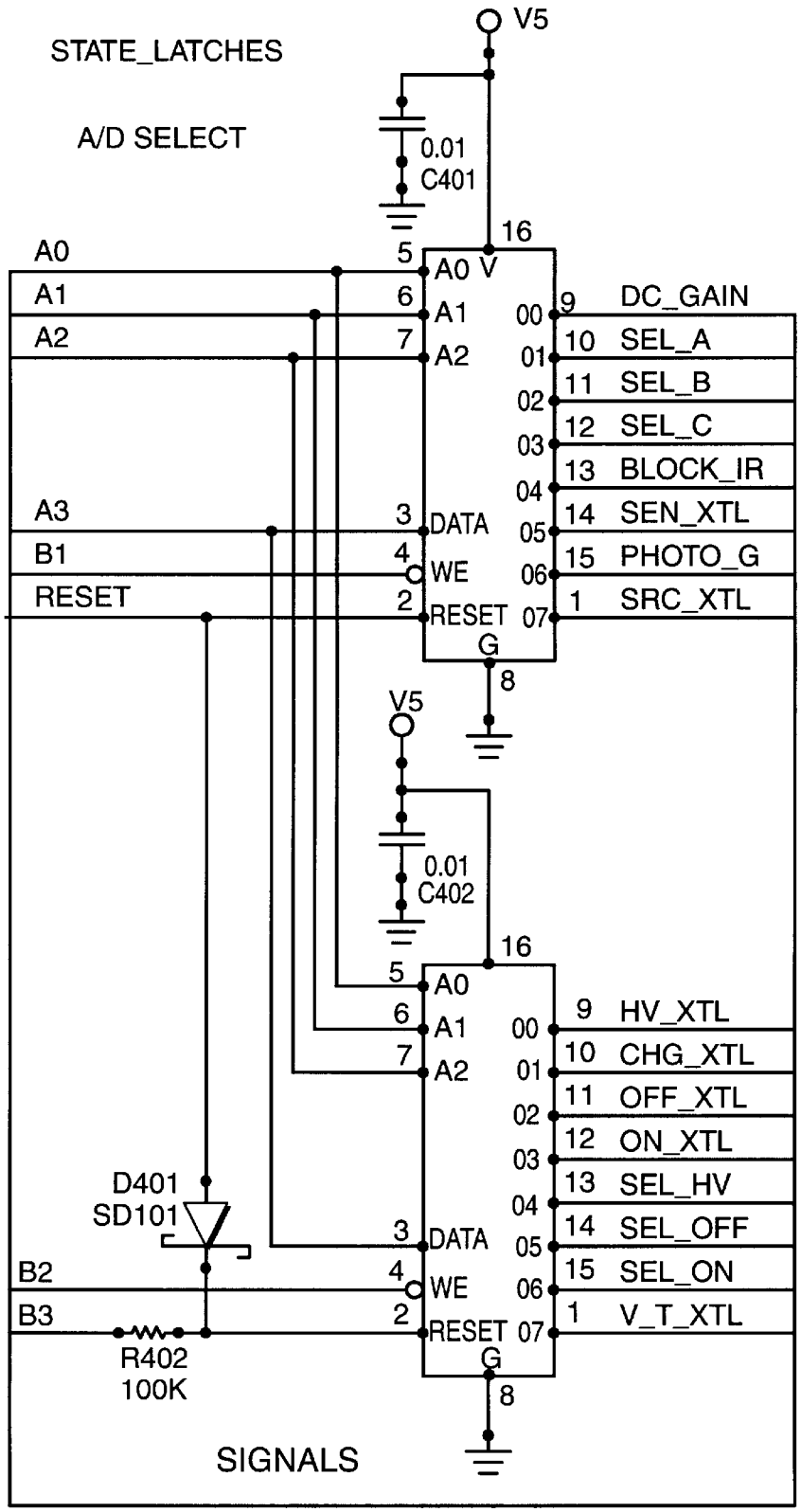
FIG. 11 is a partial electrical diagram of an embodiment of the present invention.
Figure 12A:
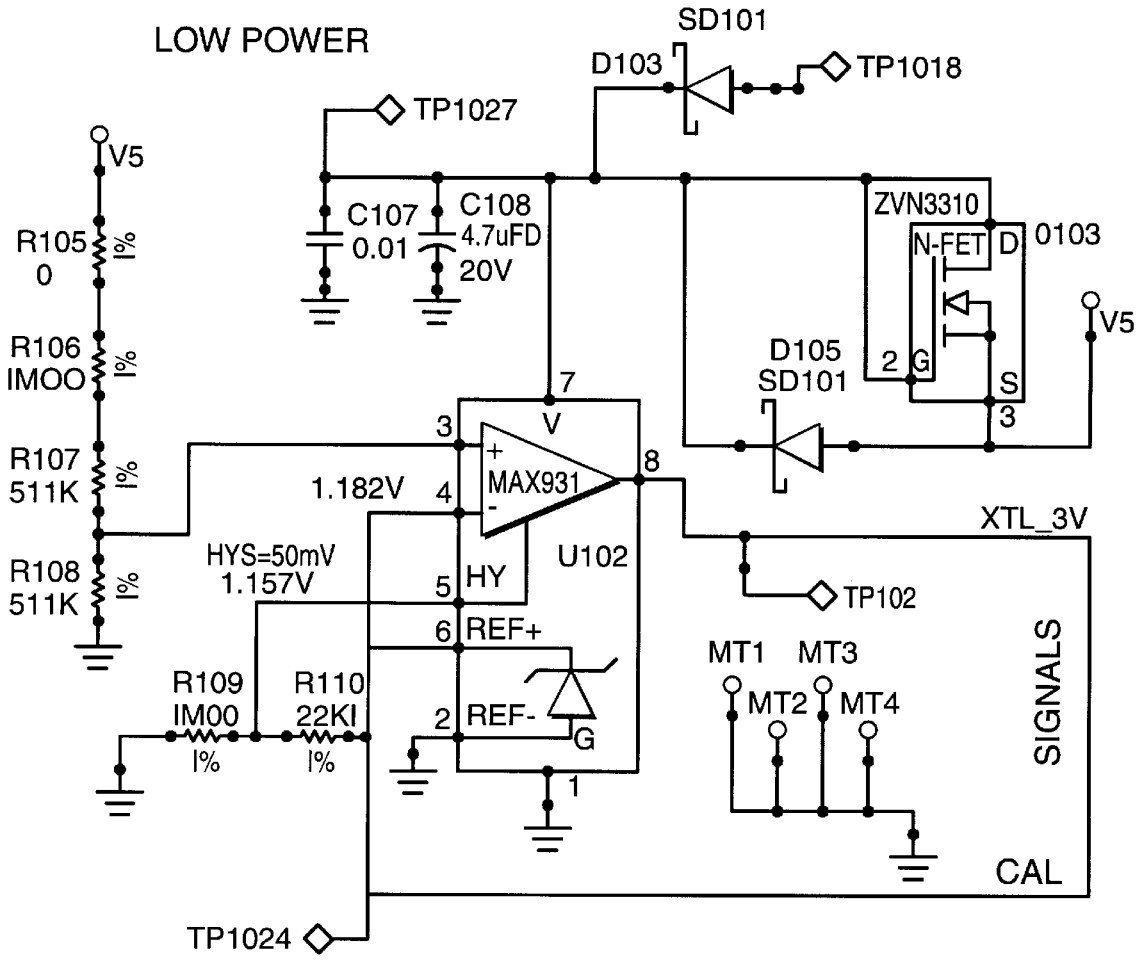
FIGS. 12A and 12B are partial electrical diagrams of an embodiment of the present invention.
Figure 12B:
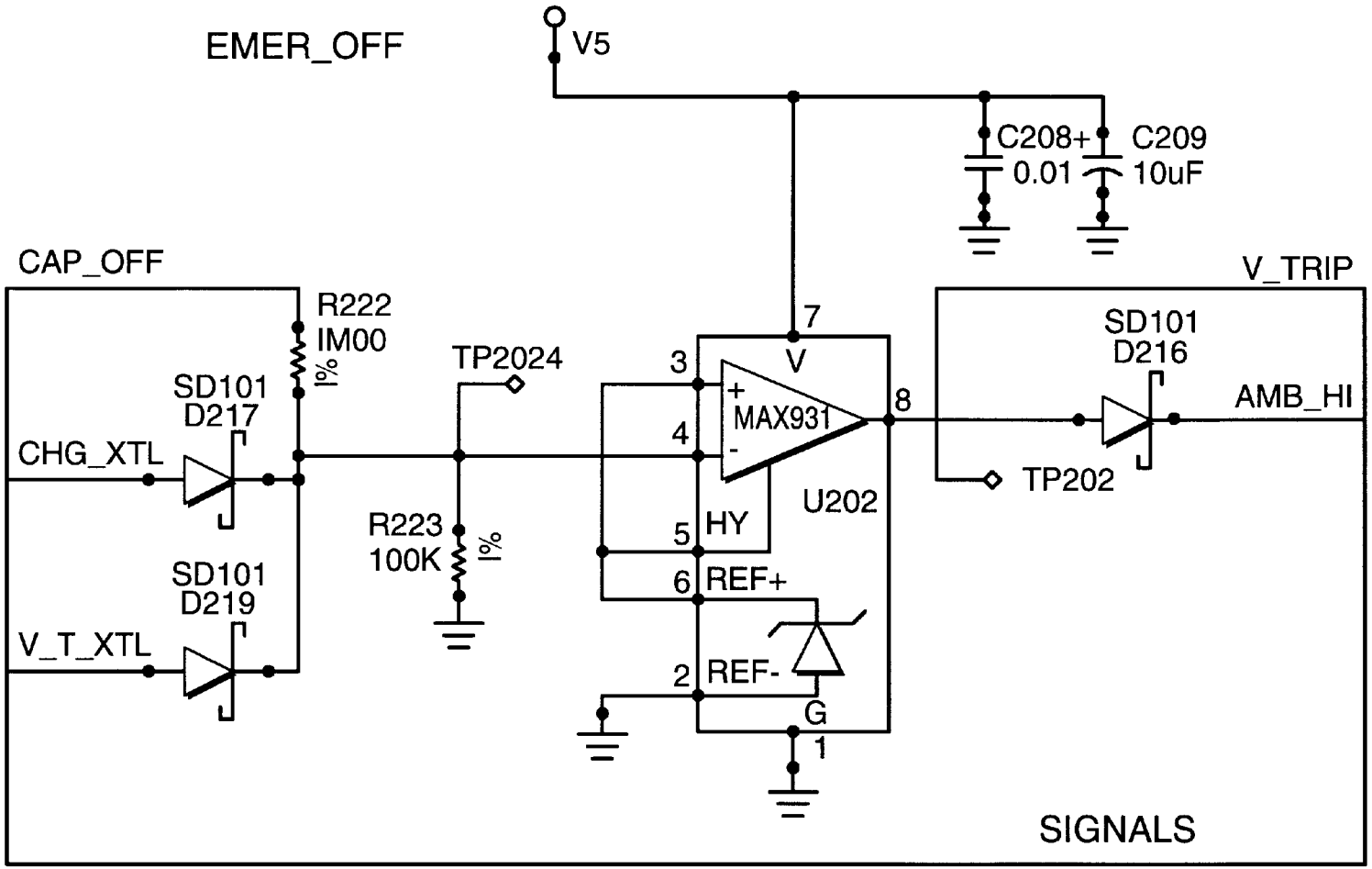
Figure 13:
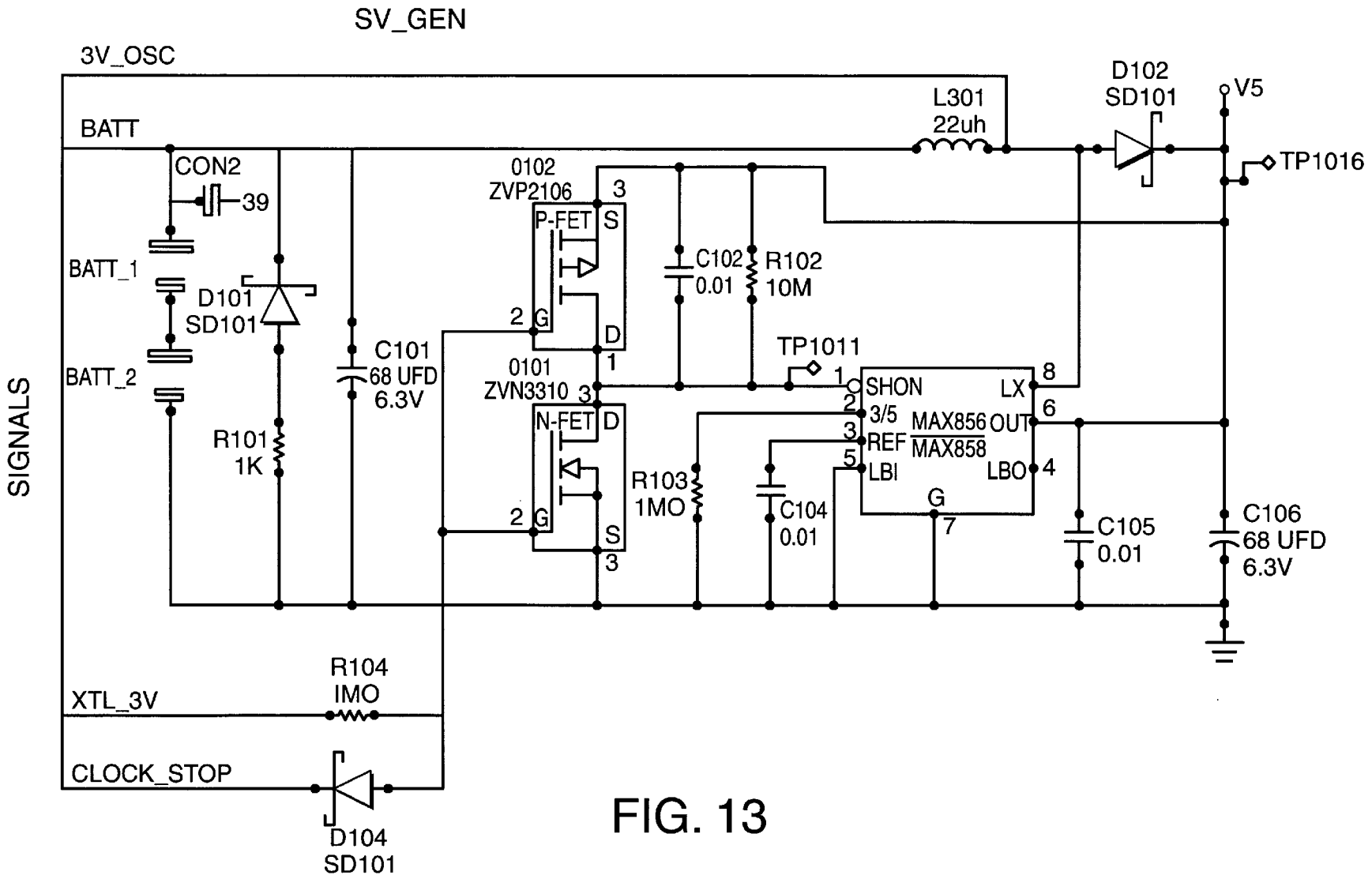
FIG. 13 is a partial electrical diagram of an embodiment of the present invention.
Figure 14:
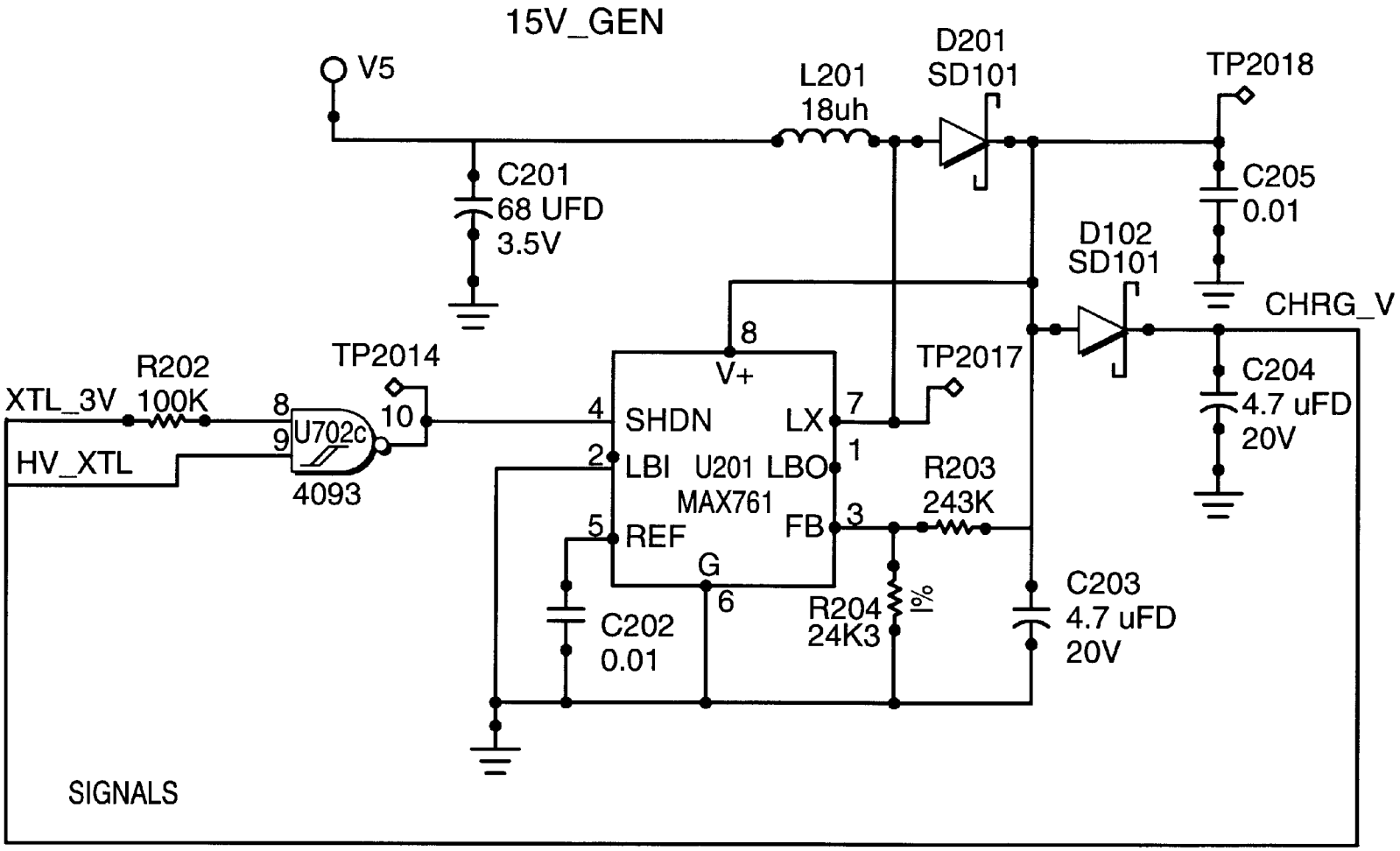
FIG. 14 is a partial electrical diagram of an embodiment of the present invention.
Figure 15:
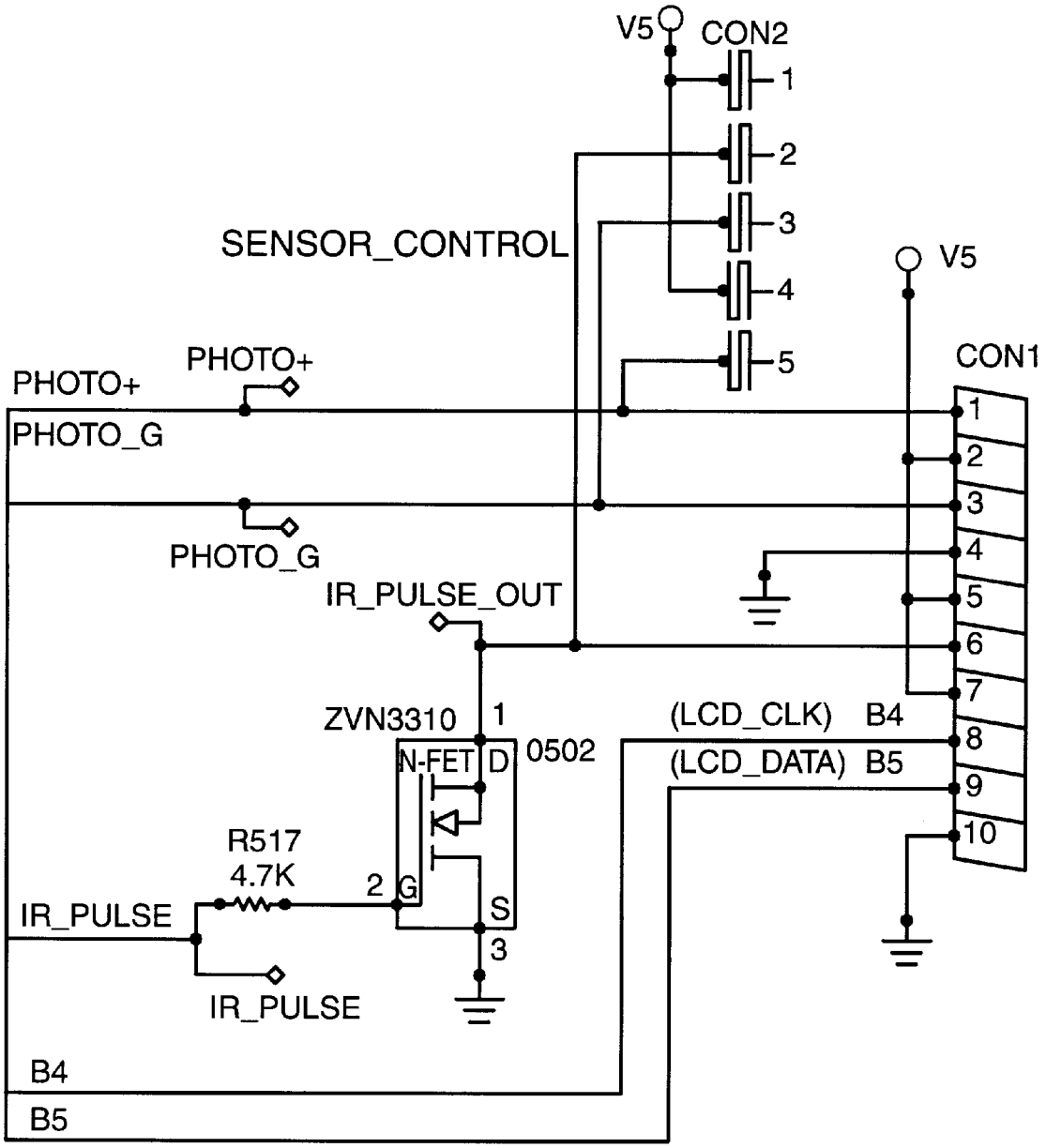
FIG. 15 is a partial electrical diagram of an embodiment of the present invention.

Circuit diagrams of the blocks represented in FIG. 2 are provided in FIGS. 6 through 15. Referring to the components of FIG. 2, FIG. 4 provides an analog-to-digital converter 40 and multiplexer 32. FIGS. 5A, 5B and 5C provide an infrared amplifier 54, infrared reflection circuit 60, RS232 detection circuit 88 and infrared motion circuit 92. FIGS. 8A and 8B provide a solenoid charge circuit 66 and a solenoid control circuit 68. FIG. 7 provides a fifteen volt measurement circuit 78. FIGS. 8A and 8B provide a timer circuit 134 and a sleep circuit 124. FIG. 9 provides a multiplexer 100. FIGS. 10A and 10B provide a CPU 34. FIG. 11 provides a state latches 38. FIGS. 12A and 12B provide a low power circuit 44 and an emergency off circuit 128. FIG. 13 provides a five volt power sources 30. FIG. 14 provides a fifteen volt generation circuit 80, and FIG. 15 provides a sensor control circuit 52. It should be understood that these diagrams are provided by way of example only.

While one or more embodiments of the invention have been described and shown, it will be understood by those of ordinary skill in this art that the present invention is not limited thereto since many modifications can be made. Therefore, it is contemplated by the present application to cover any and all such embodiments that may fall within the literal or equivalent scope of the appended claims.

What is claimed is:

1. A water faucet assembly, said assembly comprising:

a faucet operatively connected to a water source;

an energy storage element;

a valve in operative communication with said faucet and said water source to selectively permit water flow from said water source to said faucet;

a light detector mechanism configured to detect ambient light; and a control mechanism powered by said energy storage element and in operative communication with said light detector mechanism and said valve, said control mechanism configured to activate said valve to permit water flow from said water source to said faucet responsively to whether the level of ambient light detected by said light detector mechanism differs from a stored prior ambient light level by more than a threshold amount.

2. The assembly as in claim 1, including a sensor mechanism configured to emit a signal into an area proximate said faucet when said detected ambient light level differs from said prior ambient light level by more than said threshold amount and to receive a return signal reflected by an object within the area, and wherein said control mechanism is configured to activate said valve when said return signal indicates an object within said area.

3. The assembly as in claim 2, wherein said sensor mechanism is configured to emit infrared signals.

4. The assembly as in claim 1, wherein said control mechanism is configured in an active state, to control said valve, in an inactive state, to reduce energy consumption by said assembly for said energy storage element and to maintain said valve in a deactivated condition, to enter said inactive state from said active state upon failure to activate said valve for a predetermined period, to monitor ambient light detected by said light detector mechanism during said inactive state, and to enter said active state from said inactive state responsively to said detected ambient light.

5. The assembly as in claim 4, wherein said control mechanism is configured to enter said inactive state from said active state following activation of said valve for a predetermined period.

6. The assembly as in claim 4, including a sensor mechanism configured to emit a signal into an area proximate said faucet when said detected ambient light level differs from said prior ambient light level by more than said threshold amount and to receive a return signal reflected by an object within the area, and wherein said control mechanism is configured to activate said valve when said return signal indicates an object within said area.

7. The assembly as in claim 6, wherein said sensor mechanism is configured to emit infrared signals.

8. The assembly as in claim 7, wherein in said inactive state, said control mechanism disables said sensor mechanism.

9. The assembly as in claim 2, wherein said control mechanism is configured to activate said valve when said return signal exceeds a predetermined level.

10. The assembly as in claim 1, wherein said energy storage element is a battery.

11. The assembly as in claim 2, wherein said control mechanism is configured to activate said valve when said return signal indicates an object within said area before said object reaches said faucet.

12. The assembly as in claim 1, wherein said control mechanism includes a microprocessor.

13. The assembly as in claim 2, wherein said control mechanism is configured to replace said stored prior ambient light value when said return signal fails to indicate an object within said area.

14. The assembly as in claim 2, wherein said control mechanism is configured to replace said stored prior ambient light value upon deactivation of said valve.

15. The assembly as in claim 13, wherein said replaced value is equal to the average of said stored prior value and a current ambient light level detected by said light detector mechanism.

16. A water faucet assembly, said assembly comprising:

a faucet operatively connected to a water source;

an energy storage element;

a valve in operative communication with said faucet and said water source to selectively permit water flow from said water source to said faucet;

a light detector mechanism configured to detect ambient light; and a control mechanism powered by said energy storage element and in operative communication with said light detector mechanism and said valve, said control mechanism configured to activate said valve to permit water flow from said water source to said faucet responsively to the level of ambient light detected by said light detector mechanism, wherein said control mechanism is configured in an active state, to control said valve, in an inactive state, to reduce energy consumption by said assembly from said energy storage element and to maintain said valve in a deactivated condition, and to monitor ambient light detected by said light detector mechanism during said inactive state, and wherein said control mechanism includes a passive energy storage element to provide energy to activate said valve, said passive energy storage element being charged by said energy storage element, and wherein said control mechanism is configured to intermittently exit said inactive state to charge said passive energy storage element so that said passive energy storage element maintains sufficient energy to activate said valve.

17. A water faucet assembly, said assembly comprising:

a faucet operatively connected to a water source;

an energy storage element;

a valve in operative communication with said faucet and said water source to selectively permit water flow from said water source to said faucet;

a sensor circuit, said sensor circuit including a light detector mechanism configured to detect ambient light, a signal source configured to emit a signal into an area proximate said faucet, and a signal receiver configured to receive a return signal reflected by an object within the area;

a control circuit, said control circuit including a signal acquisition circuit in operative communication with said light detector mechanism and said signal receiver, said signal acquisition circuit outputting signals from said light detector mechanism corresponding to ambient light detected by said detector mechanism and outputting signals from said signal receiver corresponding to said return signals, a valve control circuit in operative communication with said valve and configured to activate and deactivate said valve, a processor circuit in operative communication with said energy storage element, said signal source, said signal acquisition circuit and said valve control circuit, said processor circuit configured to receive said ambient light signals from said signal acquisition circuit to cause said signal source to emit a signal into said area responsively to said received ambient light signals, to receive said return signals from said signal acquisition circuit and to cause said valve control circuit to activate said valve when said received return signals indicate an object within said area, wherein said control circuit is also configured in an active state, to operate said valve with said valve control circuit, in an inactive state, to reduce energy consumption by said assembly from said energy storage element and to maintain said valve in an deactivated condition, to enter said inactive state from said active state upon failure to activate said valve for a predetermined period, to monitor said ambient light signals output by said signal acquisition circuit during said inactive state, and to enter said active state from said inactive state responsively to said ambient light signals.

18. The assembly as in claim 17, wherein said processor circuit includes a microprocessor.

19. The assembly as in claim 17, wherein said light detector mechanism and said signal receiver comprise a unitary sensor.

20. The assembly as in claim 17, wherein said signal source is configured to emit infrared signals and said signal receiver is configured to receive infrared signals.

21. The assembly as in claim 17, wherein said processor circuit is configured to cause said signal source to emit said signal into said area when said ambient light signals differ from a stored prior ambient light level by more than a threshold amount.

22. The assembly as in claim 17, wherein said control circuit is configured to monitor said ambient light signals and to exit said inactive state when said light detector mechanism detects ambient light differing from a stored prior ambient light level by more than a predetermined amount.

23. A water faucet assembly, said assembly comprising:

a faucet operatively connected to a water source;

an energy storage element;

a valve in operative communication with said faucet and said water source to selectively permit water flow from said water source to said faucet;

a sensor mechanism configured to emit a signal into an area proximate said faucet and to receive a return signal reflected by an object within the area; and a control mechanism powered by said energy storage element and in operative communication with said sensor mechanism and said valve, said control mechanism being configured in an active state, to activate said valve when said return signal indicates an object within said area, in an inactive state, to reduce energy consumption by said assembly from said energy storage element and to maintain said valve in a deactivated condition, and to enter said inactive state from said active state upon failure to activate said valve for a predetermined period.

24. The assembly as in claim 23, wherein said wherein said sensor mechanism is configured to emit infrared signals.

25. The assembly as in claim 23, wherein said control mechanism is configured to activate said valve when said return signal exceeds a predetermined level.

26. The assembly as in claim 25, wherein said energy storage element is a battery.

27. The assembly as in claim 23, wherein said control mechanism includes a microprocessor.

28. The assembly as in claim 23, wherein said control mechanism includes a passive energy storage to provide energy to activate said valve, said passive energy storage element being charged by said energy storage element, and wherein said control mechanism is configured to intermittently exit said inactive state to charge said passive energy storage element so that said passive energy storage element maintains sufficient energy to activate said valve.

29. The assembly as in claim 17, wherein said processor is configured to cause said valve control circuit to activate said valve when said received return signals indicate an object within said area before said object reaches said faucet.

30. The assembly as in claim 23 including a light detector mechanism in communication with said control mechanism and being configured to detect ambient light and wherein said control mechanism is configured to exit said inactive state when said light detector mechanism detects ambient light differing from a stored prior ambient light level by more than a predetermined amount.

31. A water faucet assembly, said assembly comprising:

a faucet operatively connected to a water source;

an energy storage element;

a valve in operative communication with said faucet and said water source to selectively permit water flow from said water source to said faucet;

a sensor mechanism including a light detector mechanism configured to detect ambient light, a signal source configured to emit a signal into an area proximate said faucet, and a signal receiver configured to receive a return signal reflected by an object within the area; and a control mechanism powered by said energy storage element and in operative communication with said sensor mechanism and said valve, said control mechanism being configured in an active state, to cause said signal source to emit said signal into said area when said ambient light detected by said light detector differs from a stored prior ambient light level by more than a threshold amount and to activate said valve when said return signal indicates an object within said area, in an inactive state, to reduce energy consumption by said assembly from said energy storage element and to maintain said value in a deactivated condition, and to enter said inactive state from said active state upon failure of said detected ambient light to differ, for a predetermined period, from said prior ambient light value by more than said threshold amount.

32. A water faucet assembly, said assembly comprising:

a faucet operatively connected to a water source;

an energy storage element;

a valve in operative communication with said faucet and said water source to selectively permit water flow from said water source to said faucet;

a light detector mechanism configured to detect ambient light; and means for activating said valve to permit water flow from said water source to said faucet responsively to whether the level of ambient light detected by said light detector mechanism differs from a stored prior ambient light level by more than a threshold amount.

* * * * *